US008875738B2

(12) United States Patent
Yang et al.

(10) Patent No.: US 8,875,738 B2
(45) Date of Patent: Nov. 4, 2014

(54) POSITIONING STRUCTURE OF WATER SUPPLY HOSE FOR PULL-OUT FAUCET

(71) Applicant: Globe Union Industrial Corp., Taichung (TW)

(72) Inventors: Chaota Yang, Taichung (TW); Kuoming Tseng, Taichung (TW); Yiping Lin, Taichung (TW); Chunhung Li, Taichung (TW); Yongiun Wu, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 14/217,936

(22) Filed: Mar. 18, 2014

(65) Prior Publication Data

US 2014/0251451 A1 Sep. 11, 2014

(30) Foreign Application Priority Data

Oct. 29, 2013 (CN) ..... 2013 1 0522819

(51) Int. Cl.
*F16K 21/00* (2006.01)
*E03C 1/04* (2006.01)

(52) U.S. Cl.
CPC ..... *E03C 1/04* (2013.01)
USPC ..... 137/801

(58) Field of Classification Search
CPC ..... E03C 1/021; E03C 1/04; E03C 1/0404; E03C 1/0415
USPC ..... 137/801; 4/675–678
See application file for complete search history.

(56) References Cited

U.S. PATENT DOCUMENTS

| | | | | |
|---|---|---|---|---|
| 5,301,715 | A * | 4/1994 | Becker | 137/615 |
| 5,381,830 | A * | 1/1995 | Niemann et al. | 137/801 |
| 5,758,690 | A * | 6/1998 | Humpert et al. | 137/801 |
| 7,753,079 | B2 * | 7/2010 | Nelson | 137/801 |
| 7,909,061 | B2 * | 3/2011 | Nelson | 137/801 |
| 8,387,661 | B2 * | 3/2013 | Nelson | 137/801 |
| 8,413,686 | B2 * | 4/2013 | Ko | 137/801 |
| 8,496,028 | B2 * | 7/2013 | Nelson et al. | 137/801 |
| 2010/0170587 | A1 * | 7/2010 | Kaess | 137/801 |
| 2014/0026980 | A1 | 1/2014 | Esche et al. | |

* cited by examiner

*Primary Examiner* — Craig Schneider

(57) ABSTRACT

A positioning structure of a water supply hose for a pull-out faucet contains: a faucet body including an outlet; a water supply hose accommodated in the faucet body so as to supply water and including an outlet segment; a spraying head connected with the outlet segment of the water supply hose and being pulled outwardly and retracted inwardly with the water supply hose; a magnetic attraction device including a first connecting member and a second connecting member which magnetically attract with each other. The first connecting member is disposed in the outlet, the second connecting member is mounted on an outlet segment, the second connecting member retracts back to its original position with the water supply hose and the spraying head and moves into the outlet so as to magnetically attract with the first connecting member, hence the water supply hose and the spraying head are magnetically attracted and fixed.

9 Claims, 27 Drawing Sheets

POSITIONING STRUCTURE OF WATER SUPPLY HOSE FOR PULL-OUT FAUCET

FIELD OF THE INVENTION

The present invention relates to a pull-out faucet, and more particularly to a positioning structure of a water supply hose for the pull-out faucet.

BACKGROUND OF THE INVENTION

A conventional pull-out faucet contains a spraying head connecting with a distal end of a water supply hose, the water supply hose is accommodated in a faucet body so that the spraying head is pulled out of an outlet of the faucet body by a user, and a weight block on the water supply hose provides gravity so that the spraying head retracts back to its original position with the water supply hose after the user releases the spraying head, thus positioning the spraying head in the outlet of the faucet body.

Furthermore, a balancing weight can be used to replace the weighting block, for example, the balancing weight facilitates the spraying head to retract back to an original position with the water supply hose.

However, the spraying head cannot contact with the outlet of the faucet body exactly. To improve such a problem, a fastening connector or a connector with a flange or paw is arranged to connect the spraying head and the faucet body together, but the connectors include at least one resilient element for providing elasticity, so the at least one resilient element becomes loose after a long period of using time.

A magnetic attraction structure is disclosed in U.S. Pat. No. 7,909,062 and is applied to replace the connectors, i.e., a magnetic connecting device is fixed on the faucet body and the spraying head so as to magnetically attract with a distal end of the spraying head.

Unfortunately, the magnetic connecting device is mounted on the faucet body and the spraying head, so when the spraying head is removed or replaced, the magnetic connecting device cannot be used.

The magnetic connecting device has lower fixing tolerance, thereby increasing manufacturing difficulty. For instance, when a connecting size or a fixing position is more than a tolerance value, two magnetic attracting elements corresponding to the magnetic connecting device are damaged easily. Moreover, a distance between two magnetic attracting elements is long, thus reducing magnetic attracting force.

The present invention has arisen to mitigate and/or obviate the afore-described disadvantages.

SUMMARY OF THE INVENTION

One aspect of the present invention is to provide a positioning structure of a water supply hose for a pull-out faucet which is capable of overcoming the shortcomings of the conventional positioning structure of a water supply hose.

To obtain the above, a positioning structure of a water supply hose of the present invention contains:

a faucet body including an outlet; a water supply hose accommodated in the faucet body so as to supply water and including an outlet segment; a spraying head connected with the outlet segment of the water supply hose and being pulled outwardly and retracted inwardly with the water supply hose; a magnetic attraction device including a first connecting member and a second connecting member which magnetically attract with each other. The first connecting member is disposed in the outlet, the second connecting member is mounted on an outlet segment, the second connecting member retracts back to its original position with the water supply hose and the spraying head and moves into the outlet so as to magnetically attract with the first connecting member, hence the water supply hose and the spraying head are magnetically attracted and fixed.

Thereby, the positioning structure of the water supply hose of the present invention has advantages as follows:

1. Because between the two outlets of the two faucet bodies and two outlet segments of the two water supply hoses are defined the two magnetic attraction devices, when the two water supply hoses are retracted back to their original positions with the two spraying heads, the two water supply hoses and the two spraying heads are attracted and fixed by the two magnetic attraction devices.

2. The two magnetic attraction devices are mounted on the two water supply hoses instead of a conventional spraying head, so the user can remove and replace the two spraying heads easily, and the two magnetic attraction devices cannot be interfered while replacing the two spraying heads.

3. The two first connecting members of the two magnetic attraction devices magnetically attract with the two connecting members in a radial direction instead of a conventionally axial direction, so a gap between a respective one of two first connecting members and a respective one of the two second connecting members is maintained at a larger connecting tolerance while the respective one of the two first connecting members magnetically attracts with the respective one of the two connecting members, thus obtaining easy manufacture and assembly. In addition, the respective one of the two first connecting members will not contact with the respective one of the two second connecting members and will not interfere positioning operation of the two spraying heads.

4. The two first connecting members of the two magnetic attraction devices are served to replace a conventional fixing loop in the faucet body and to magnetically attract with the two second connecting members without removing the two water supply hoses and the two spraying heads, thereby positioning the two second connecting members easily.

5. The two magnetic attraction devices are replaced or connected conveniently.

DETAILED DESCRIPTION OF THE PREFERRED EMBODIMENTS

Figure 1:
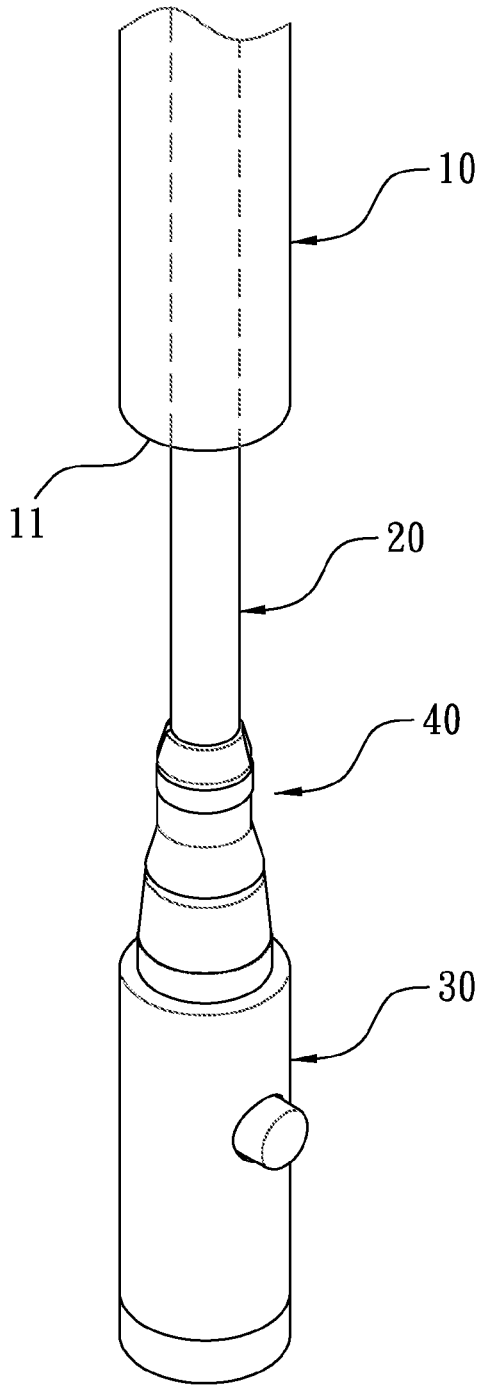
FIG. 1 is a perspective view showing the assembly of a positioning structure of a water supply hose for a pull-out faucet according to a first embodiment of the present invention.
Figure 2:
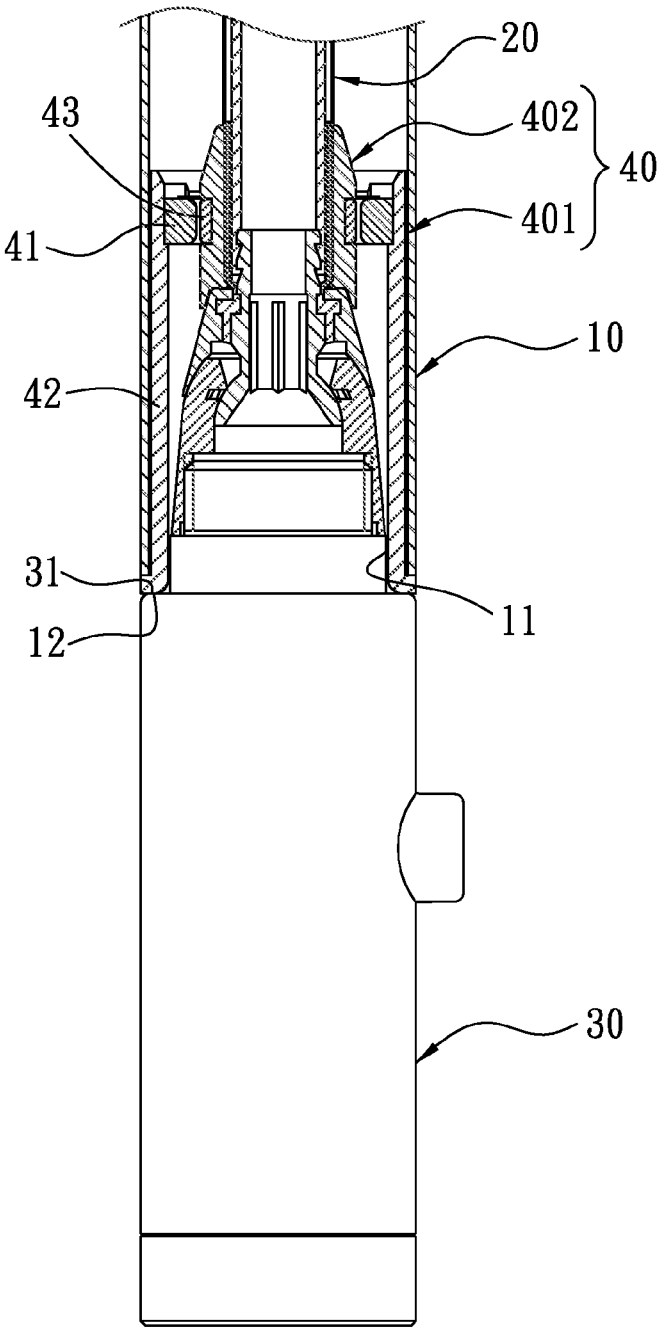
FIG. 2 is a cross sectional view showing the assembly of a part of the positioning structure of the water supply hose for the pull-out faucet according to the first embodiment of the present invention.

With reference to FIGS. 1 and 2, a positioning structure of a water supply hose for a pull-out faucet according to a first embodiment of the present invention comprises a faucet body 10, a water supply hose 20, a spraying head 30, and a magnetic attraction device 40.

The faucet body 10 includes an outlet 11.

Figure 3:
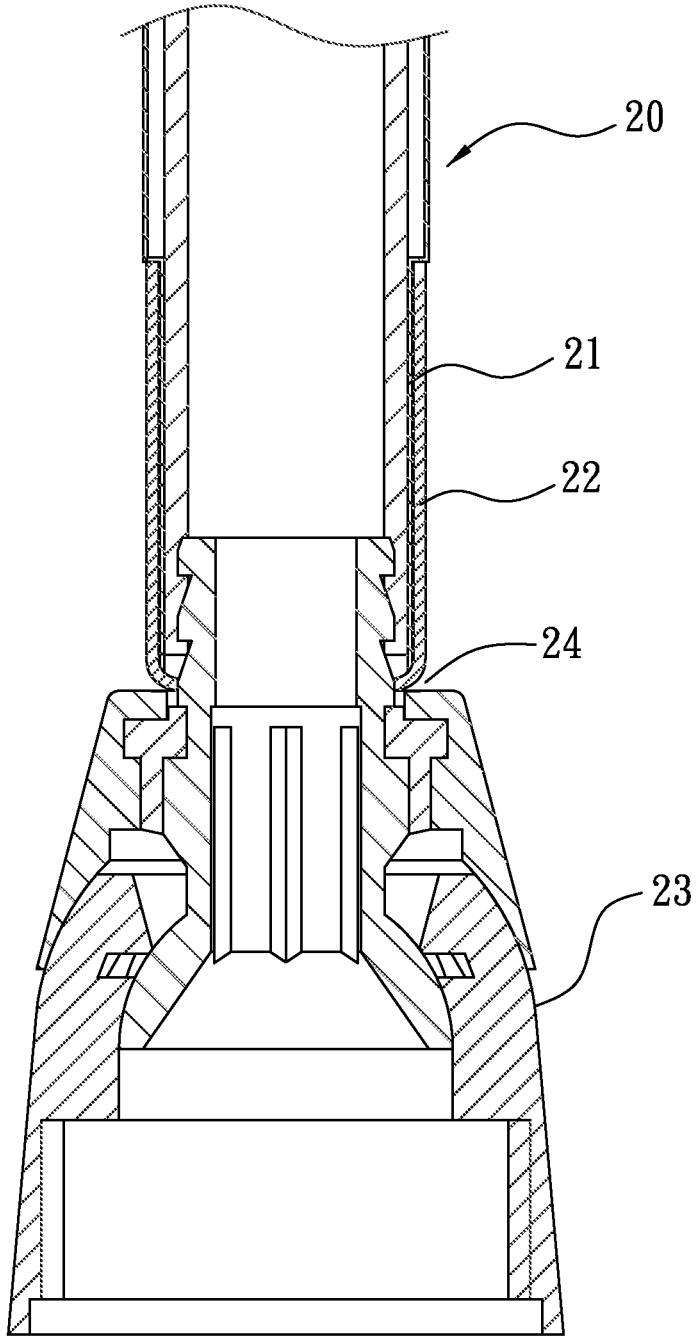
FIG. 3 is a perspective view showing the assembly of an outlet segment of the positioning structure of the water supply hose for the pull-out faucet according to the first embodiment of the present invention.

The water supply hose 20, as shown in FIG. 3, is accommodated in the faucet body 10 so as to supply water and includes an outlet segment 21; wherein the outlet segment 21 has a limiting sleeve 22, a connector 23, and an annular groove 24 defined between the limiting sleeve 22 and the connector 23.

The spraying head 30 is connected with the outlet segment 21 of the water supply hose 20 and is pulled outwardly and retracted inwardly with the water supply hose 20 by a user.

Figure 4:
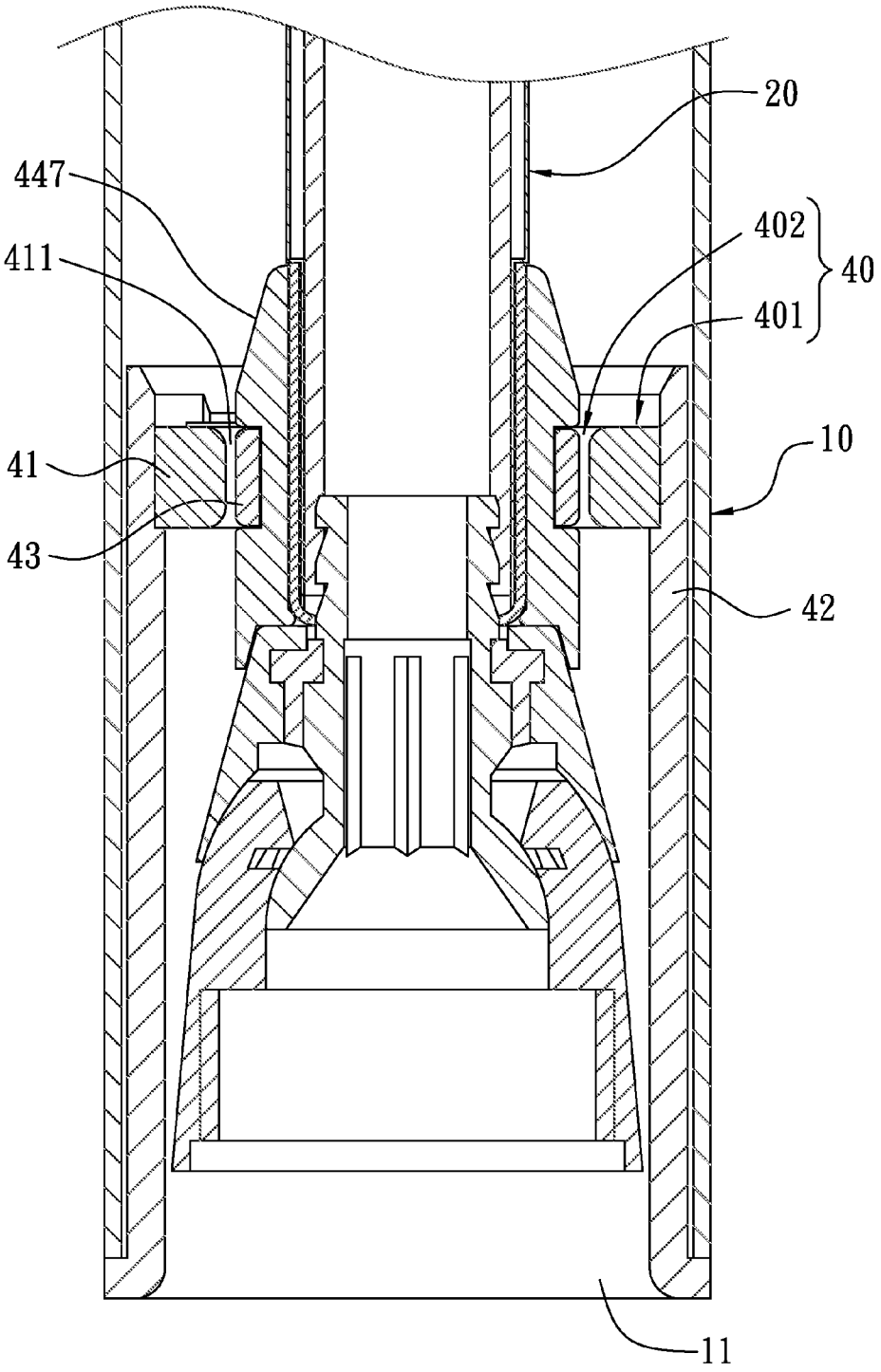
FIG. 4 is a cross sectional view showing the assembly of the positioning structure of the water supply hose for the pull-out faucet according to the first embodiment of the present invention.

The magnetic attraction device 40, as illustrated in FIGS. 2 and 4, includes a first connecting member 401 and a second connecting member 402 which magnetically attract with each other; the first connecting member 401 is disposed in the outlet 11 of the faucet body 10; the second connecting member 402 is mounted on an outlet segment 21 of the water supply hose 20; the second connecting member 402 retracts back to its original position with the water supply hose 20 and the spraying head 30 and moves into the outlet 11 of the faucet body 10 so as to magnetically attract with the first connecting member 401, hence the water supply hose 20 and the spraying head 30 are magnetically attracted and fixed.

Preferably, the first connecting member 401 has a first attracting element 41, and the first attracting element 41 is one of a magnet and a magnetically attractive material; the second connecting member 402 has a second attracting element 43, and the second attracting element 43 is the other of the magnet and the magnetically attractive material.

Figure 5:
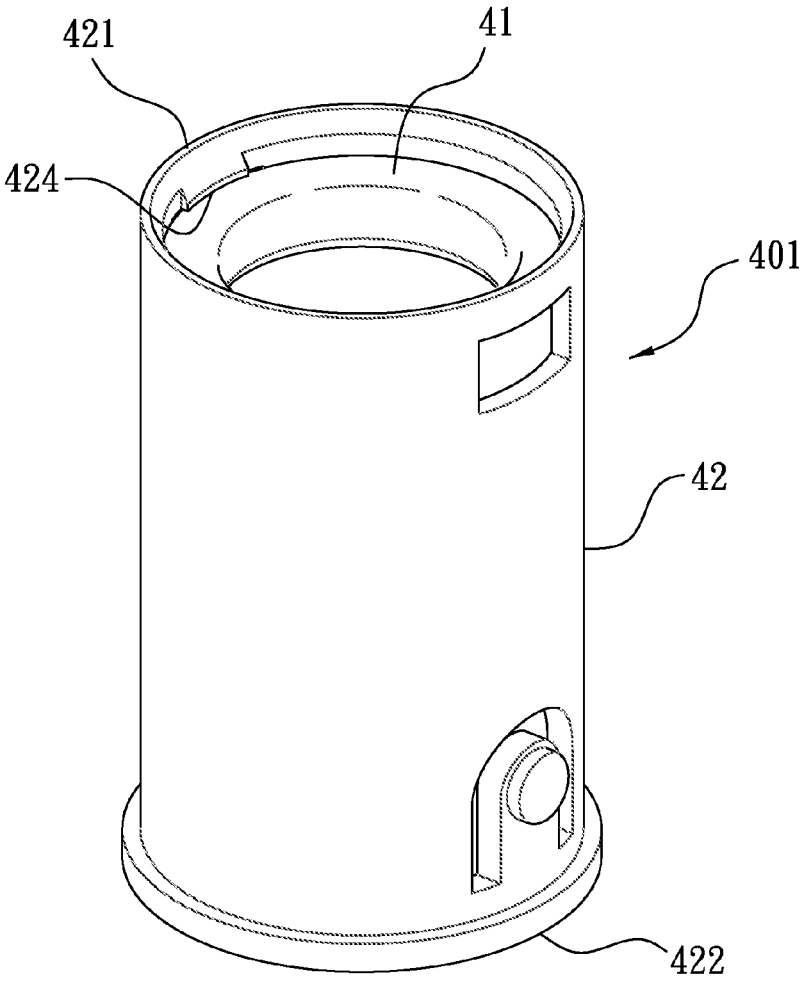
FIG. 5 is a perspective view showing the assembly of a first connecting member of the positioning structure of the water supply hose for the pull-out faucet according to the first embodiment of the present invention.

Referring to FIGS. 4 and 5, the first connecting member 401 has the first attracting element 41 and a fixing loop 42; the fixing loop 42 is fitted in the outlet 11 of the faucet body 10 so as to connect with the first attracting element 41.

Figure 6:
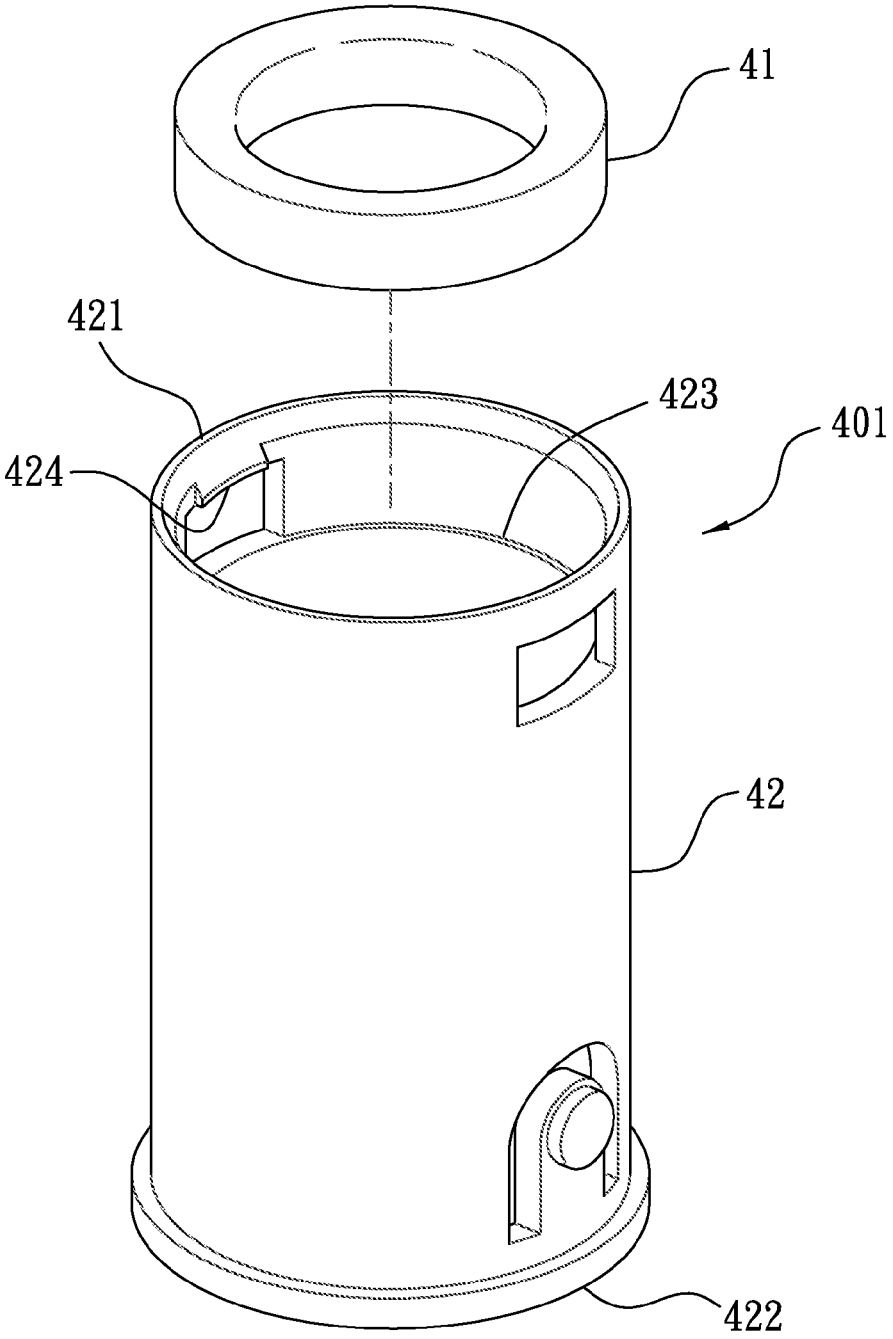
FIG. 6 is a perspective view showing the exploded components of the first connecting member of the positioning structure of the water supply hose for the pull-out faucet according to the first embodiment of the present invention.
Figure 7:
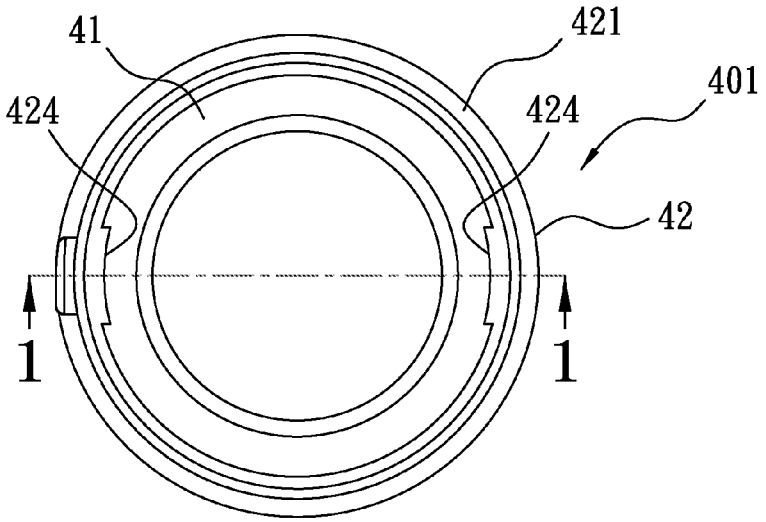
FIG. 7 is a top plan view showing the assembly of the first connecting member of the positioning structure of the water supply hose for the pull-out faucet according to the first embodiment of the present invention.
Figure 8:
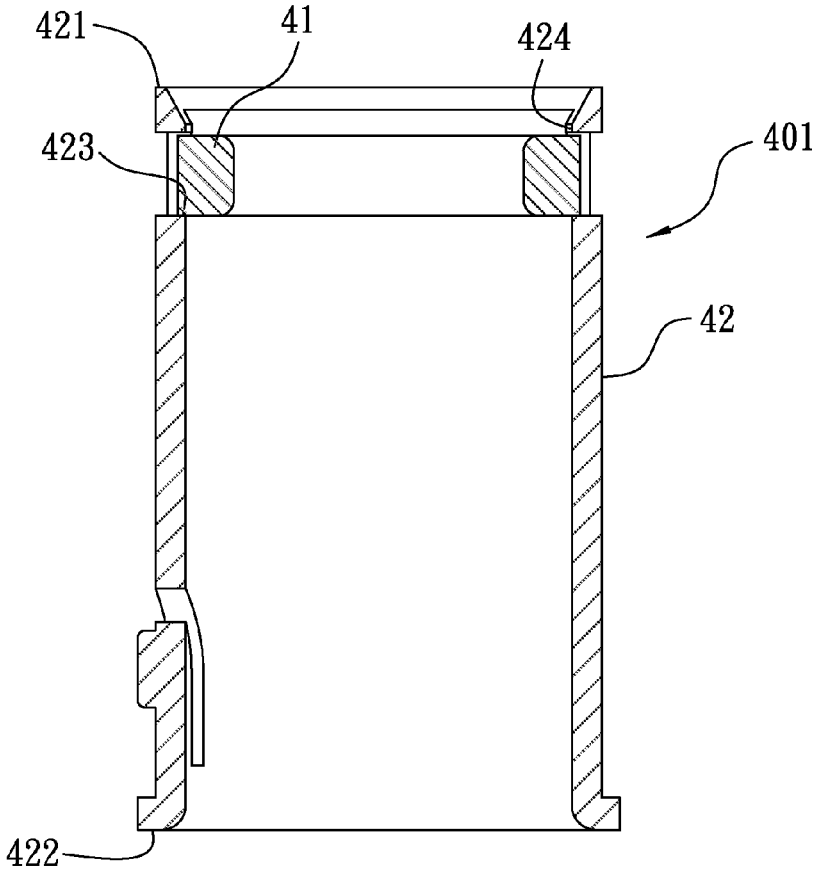
FIG. 8 is a cross sectional view taken along the line 1-1 of FIG. 7.

The fixing loop 42 has an inner peripheral segment 421, an outer rib 422, an inner shoulder 423 surrounding around an inner wall thereof opposite to the inner peripheral segment 421, and at least one locking block 424 as shown in FIGS. 6 to 8. The first attracting element 41 is circular and is retained between the inner shoulder 423 and the at least one locking block 424 through the at least one locking block 424, the first attracting element 41 is the magnet, and the second attracting element 43 is the magnetically attractive material.

Figure 9:
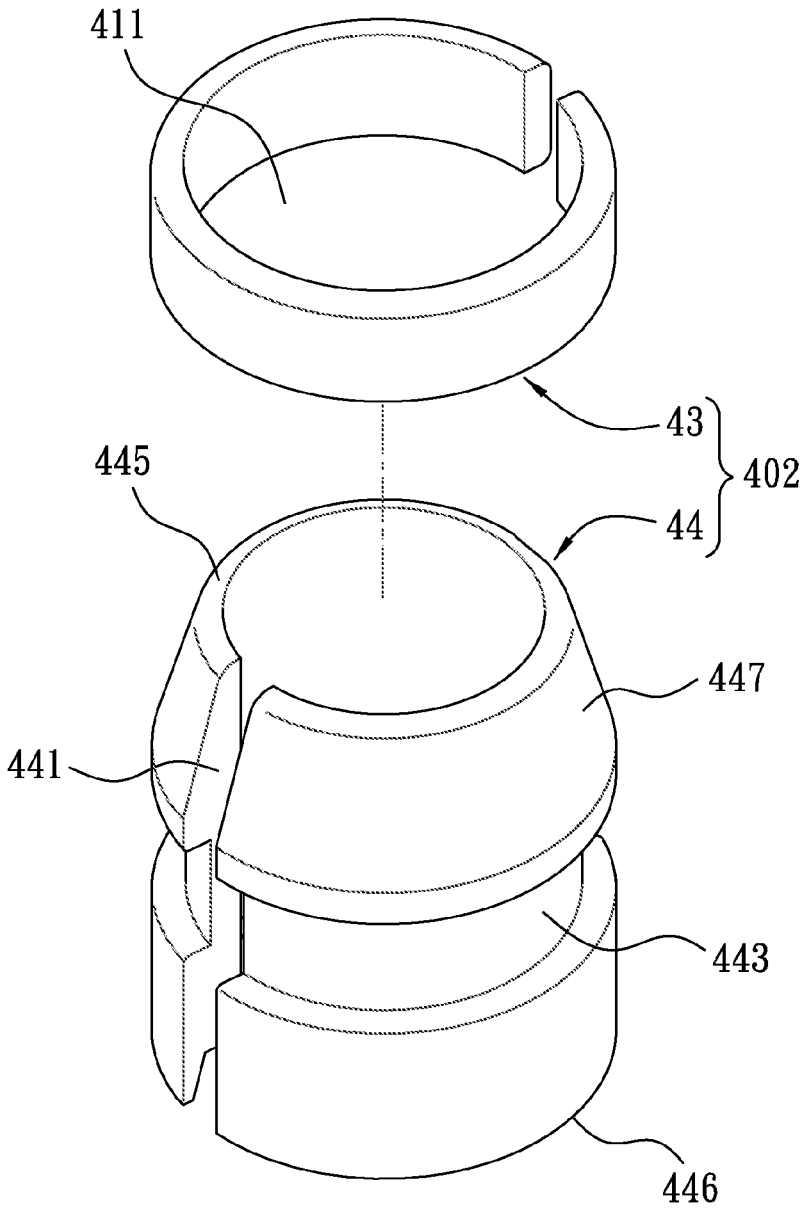
FIG. 9 is a perspective view showing the exploded components of a second connecting member of the positioning structure of the water supply hose for the pull-out faucet according to the first embodiment of the present invention.
Figure 10:
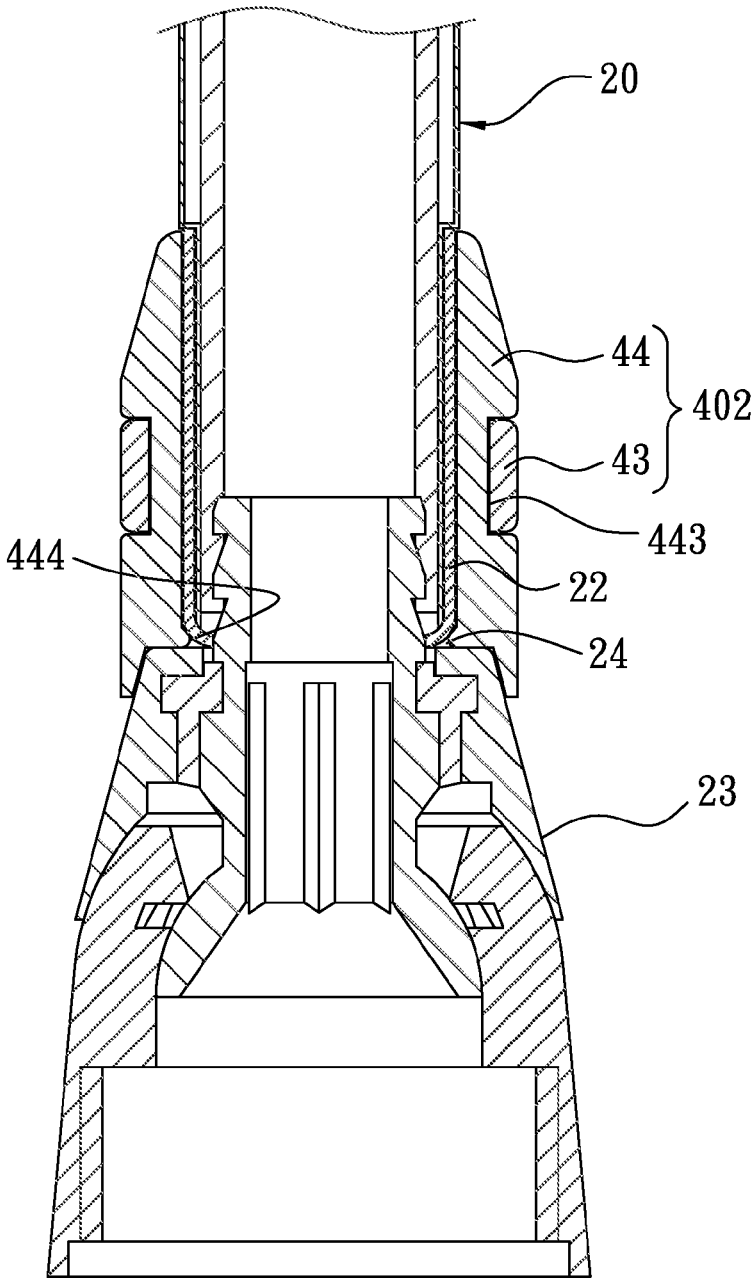
FIG. 10 is a cross sectional view showing the operation of the second connecting member of the positioning structure of the water supply hose for the pull-out faucet according to the first embodiment of the present invention.

As shown in FIG. 9, the second connecting member 402 has the second attracting element 43 and a guiding sheath 44; the second attracting element 43 is employed to magnetically attract with the first attracting element 41; the guiding sheath 44 is applied to accommodate the second attracting element 43 and is fixed on the limiting sleeve 22 of the water supply hose 20 and the connector 23 as illustrated in FIG. 10.

The guiding sheath 44 is one piece made of plastic material and is hollow as shown in FIG. 9, and the guiding sheath 44 has an elongated aperture 441 longitudinally defined on an outer wall thereof so that the guiding sheath 44 covers an outer wall of the limiting sleeve 22 of the water supply hose 20 by ways of the elongated aperture 441.

Figure 11:
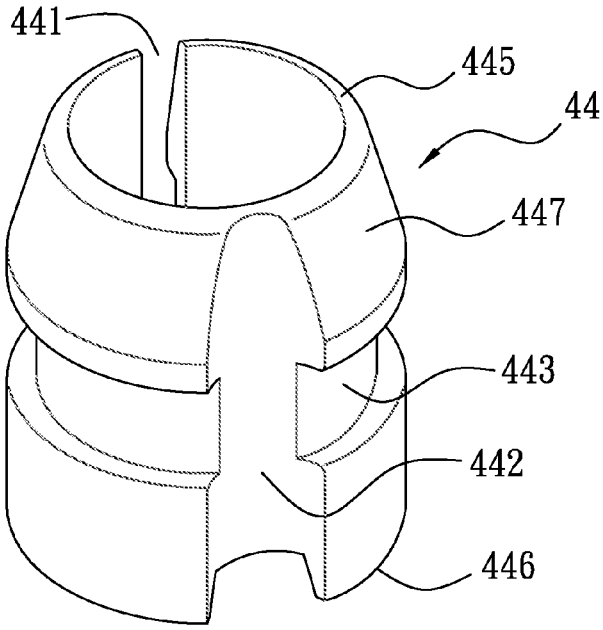
FIG. 11 is a perspective view showing the assembly of a guiding sheath of the positioning structure of the water supply hose for the pull-out faucet according to the first embodiment of the present invention.

The guiding sheath 44 also has a longitudinal slot 442 formed on the outer wall thereof opposite to the elongated aperture 441 as shown in FIG. 11, and the longitudinal slot 442 has a thinner wall than the outer wall of the guiding sheath 44 so as to rotatably open and close the elongated aperture 441, such that the guiding sheath 44 covers the outer wall of the limiting sleeve 22 easily and quickly.

To connect the second attracting element 43 easily, the guiding sheath 44 further has a positioning trench 443 defined around the outer wall thereof, and the second attracting element 43 is formed in a C shape, such that the second attracting element 43 is flexibly retained in the positioning trench 443.

Figure 12:
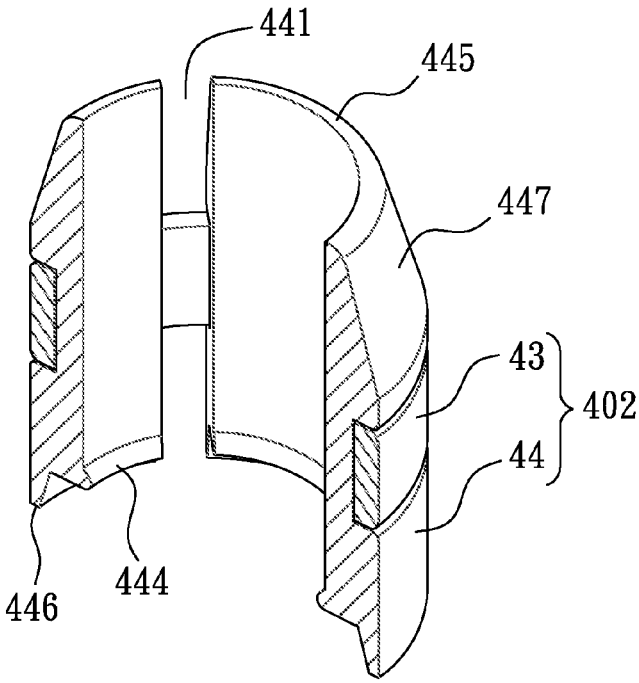
FIG. 12 is a cross-sectional perspective view showing the assembly of the second connecting member of the positioning structure of the water supply hose for the pull-out faucet according to the first embodiment of the present invention.

To couple the guiding sheath 44 conveniently, the guiding sheath 44 further has a protrusion 444 formed around an inner wall thereof as shown in FIGS. 10 and 12 so as to retain with the annular groove 24 of the water supply hose 20, such that the guiding sheath 44 is limited to move along the limiting sleeve 22.

The first attracting element 41 is circular and has an orifice 411 defined thereon as illustrated in FIG. 9 so that the second attracting element 43 is moved into the first attracting element 41 to magnetically attract with the first attracting element 41.

Referring to FIGS. 9, 11 and 12, the guiding sheath 44 further has an internal segment 445, an external segment 446, and a conical guide face 447 formed on the outer wall thereof adjacent to the internal segment 445 so as to guide the guiding sheath 44 to fit into the orifice 411 of the first attracting element 41 as shown in FIG. 4, such that the second attracting element 43 on the guiding sheath 44 faces to and magnetically attracts with the first attracting element 41.

Figure 13:
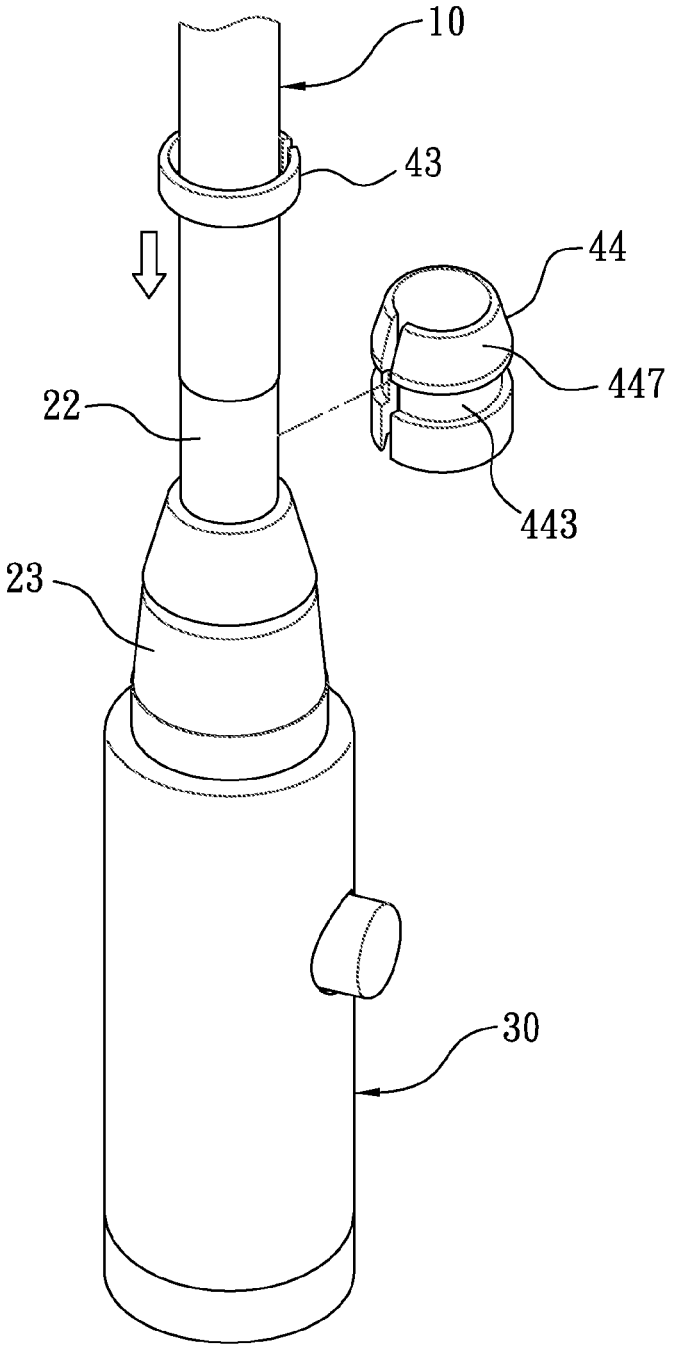
FIG. 13 is a perspective view showing the operation of the second connecting member of the positioning structure of the water supply hose for the pull-out faucet according to the first embodiment of the present invention.

With reference to FIG. 13, before connecting the guiding sheath 44, the second attracting element 43 is fitted on the limiting sleeve 22 of the water supply hose 20 and then is moved downwardly so that the second attracting element 43 is guided to move into the positioning trench 443 by using the conical guide face 447 of the guiding sheath 44, thus retaining the second attracting element 43 in the positioning trench 443.

Figure 14:
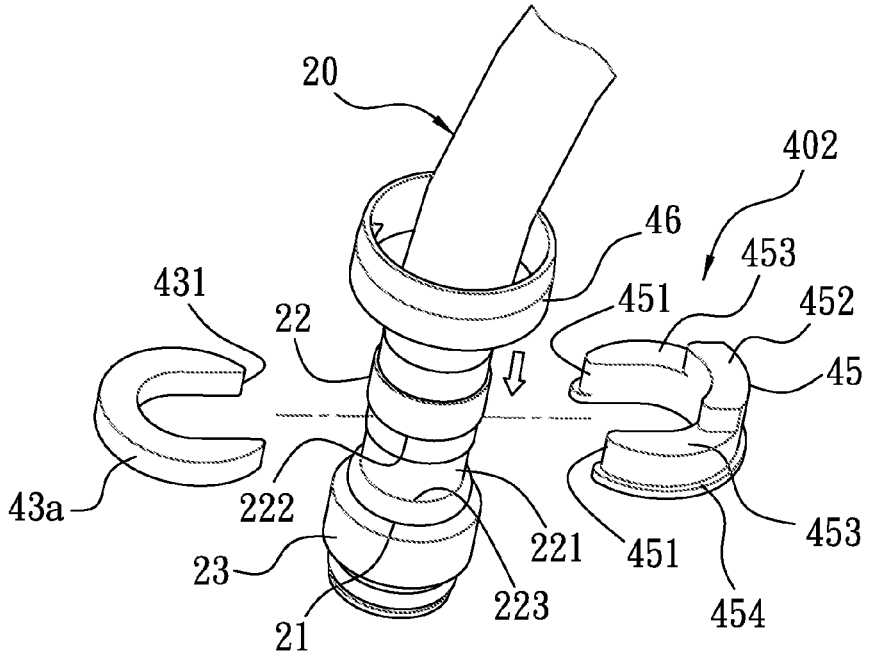
FIG. 14 is a perspective view showing the operation of a second connecting member of a positioning structure of a water supply hose for a pull-out faucet according to a second embodiment of the present invention.

Referring to FIG. 14, a difference of a positioning structure of a water supply hose of a second embodiment from that of the first embodiment comprises:

a limiting sleeve 22 of a water supply hose 20 having an annular recess 221 formed around an outer wall thereof, and the annular recess 221 having an upper fringe 222 and a lower fringe 223 which are arranged on two ends of the annular recess 221.

Figure 15:
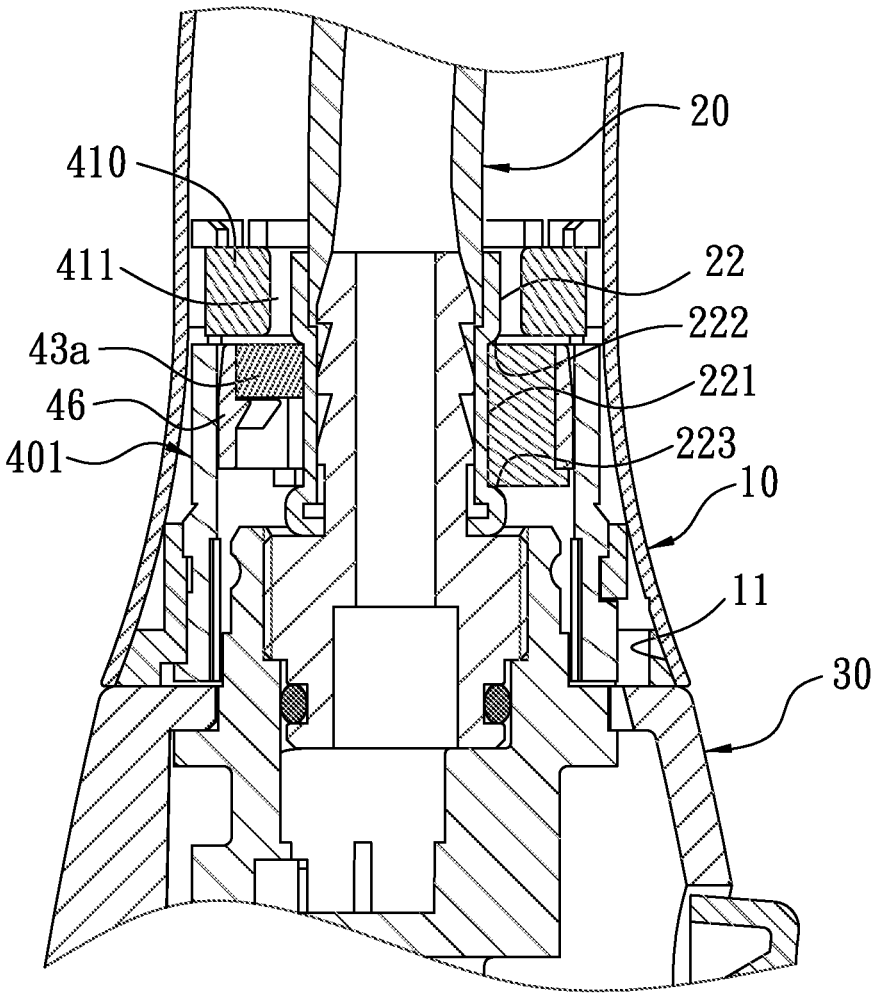
FIG. 15 is a cross sectional view showing the assembly of a part of the positioning structure of the water supply hose for the pull-out faucet according to the second embodiment of the present invention.

As shown in FIG. 15, a first attracting element 410 of a first connecting member 401 is a magnetically attractive material and has an orifice 411 defined therein.

A second attracting element **43*a* of a second connecting member 402** is a magnet.

The second connecting member 402 has an inner retainer 45 and an outer retainer 46 which are used to replace the guiding sheath 44 of the first embodiment; wherein the inner retainer 45 is formed in a C shape and has two first free segments 451 flexibly expanding to retain with an outer wall of the annular recess 221 and to be limited between the upper fringe 222 and the lower fringe 223; the second attracting element **43*a* has two second free segments 431 flexibly expanding to retain with the outer wall of the annular recess 221 and to be limited between the upper fringe 222 and the inner retainer 45; the outer retainer 46 is fitted above the limiting sleeve 22 from an outlet segment 21 of the water supply hose 20 and then is moved downwardly so that the inner retainer 45 and the second attracting element 43*a* are limited in the outer retainer 46, such that the outer retainer 46 is limited by the inner retainer 45 to move downwardly and is restricted by the second attracting element 43*a*** to move upwardly.

Figure 16:
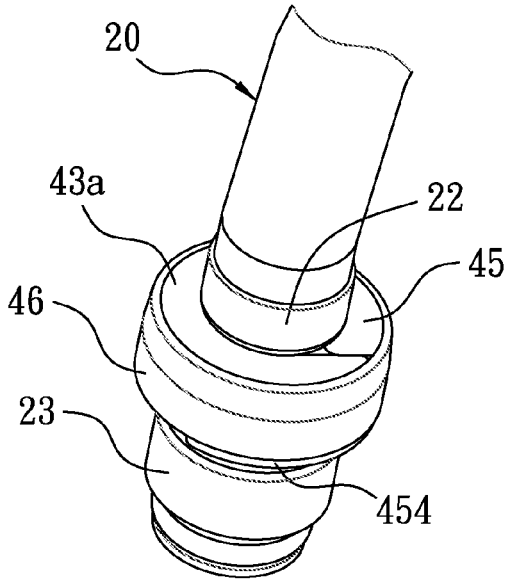
FIG. 16 is a perspective view showing the operation of the second connecting member of the positioning structure of the water supply hose for the pull-out faucet according to the second embodiment of the present invention.
Figure 17:
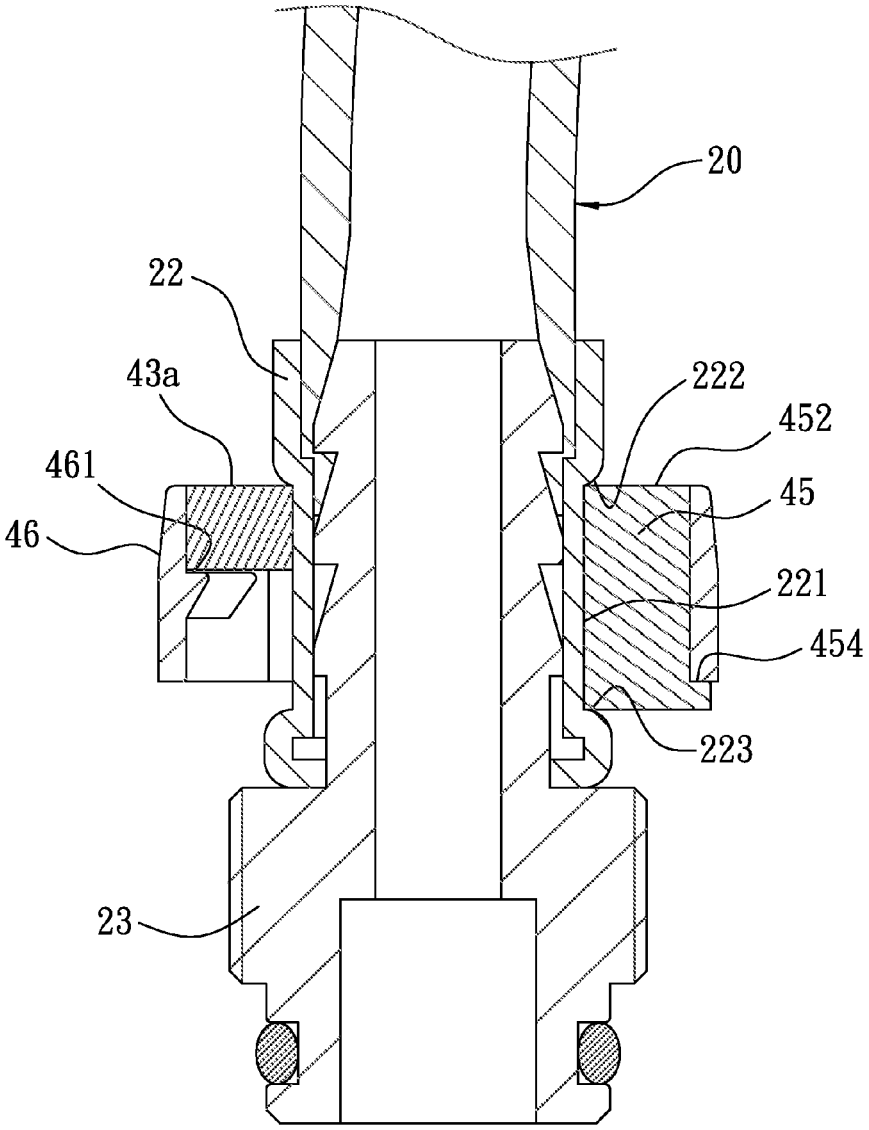
FIG. 17 is a cross sectional view showing the operation of the second connecting member of the positioning structure of the water supply hose for the pull-out faucet according to the second embodiment of the present invention.

Furthermore, the inner retainer 45 has a protrusion 452 arranged on a top end thereof and two stepped faces 453 located on two sides of the protrusion 452; a top end of the protrusion 452 abuts against the upper fringe 222 of the annular recess 221 as shown in FIGS. 16 and 17; a bottom end of the second attracting element **43*a* contacts with the two stepped faces 453 of the inner retainer 45, and the two second free segments 431 of the second attracting element 43*a* abut against two sides of the protrusion 452**.

The inner retainer 45 also has a stopping rib 454 arranged around an peripheral side of a bottom end thereof so as to abut against a bottom end of the outer retainer 46, thereby limiting the outer retainer 46 to move downwardly.

The outer retainer 46 has a hooked projection 461 extending outwardly from an inner wall thereof, such that when the outer retainer 46 moves downwardly, the hooked projection 461 passes through the second attracting element **43*a* to hook the bottom end of the second attracting element 43*a*, thus limiting the outer retainer 46** to move upwardly.

The inner retainer 45 and the outer retainer 46 are fixed on the second attracting element **43*a* so as to move to the orifice 411 of the first attracting element 41 when the water supply hose 20 retracts back to its original position, hence the second attracting element 43*a* magnetically attracts with the first attracting element 41**.

Figure 18:
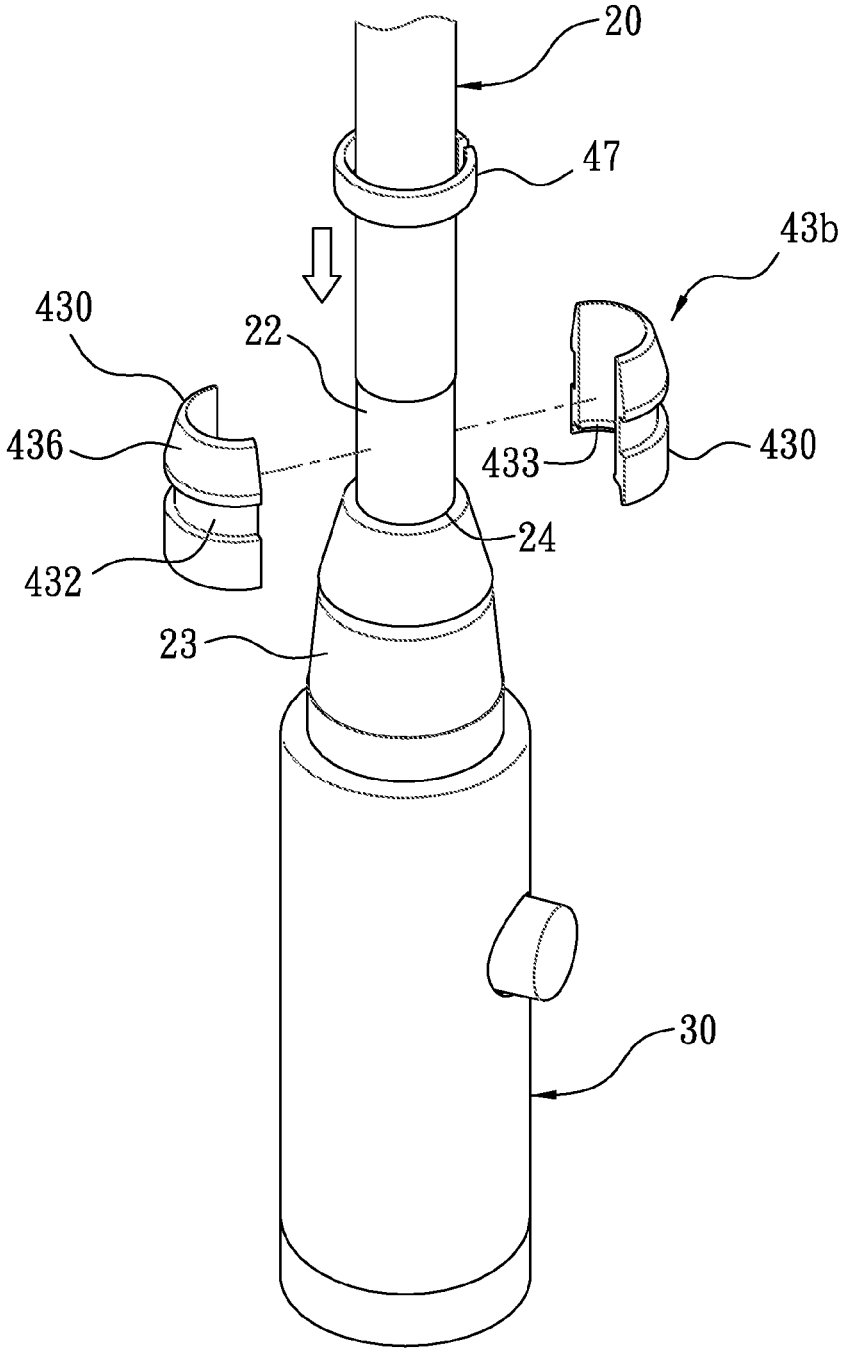
FIG. 18 is a perspective view showing the operation of a second connecting member of a positioning structure of a water supply hose for a pull-out faucet according to a third embodiment of the present invention.
Figure 19:
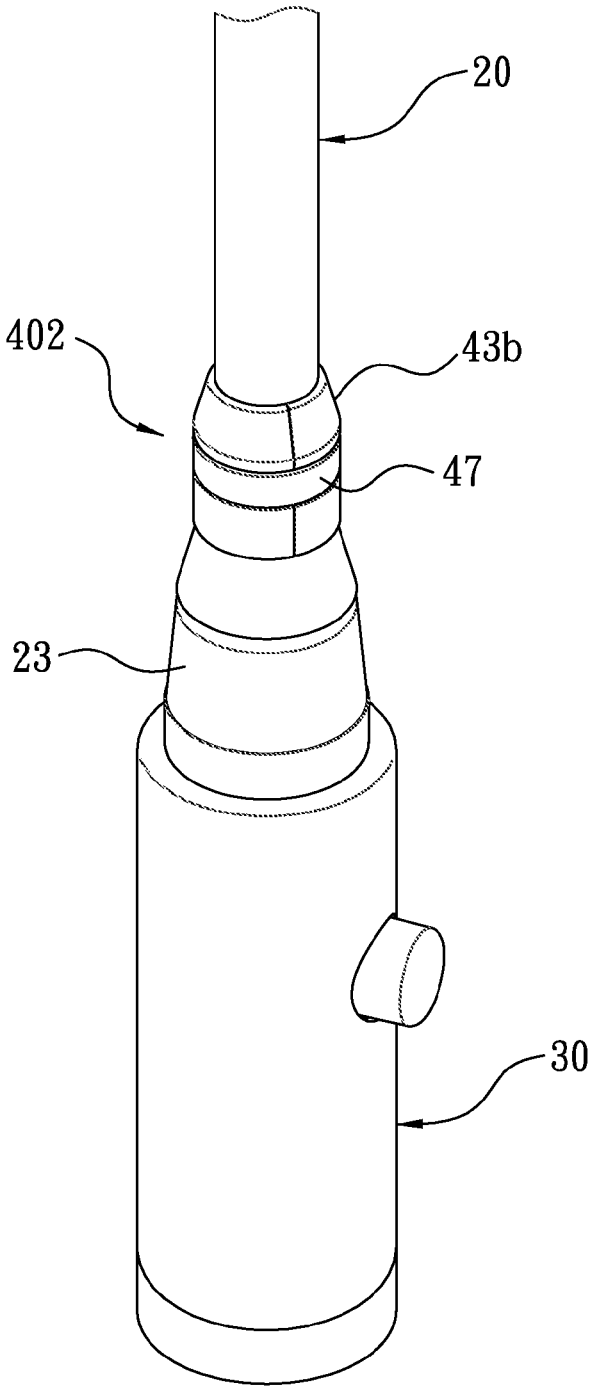
FIG. 19 is a perspective view showing the operation of the second connecting member of the positioning structure of the water supply hose for the pull-out faucet according to the third embodiment of the present invention.
Figure 20:
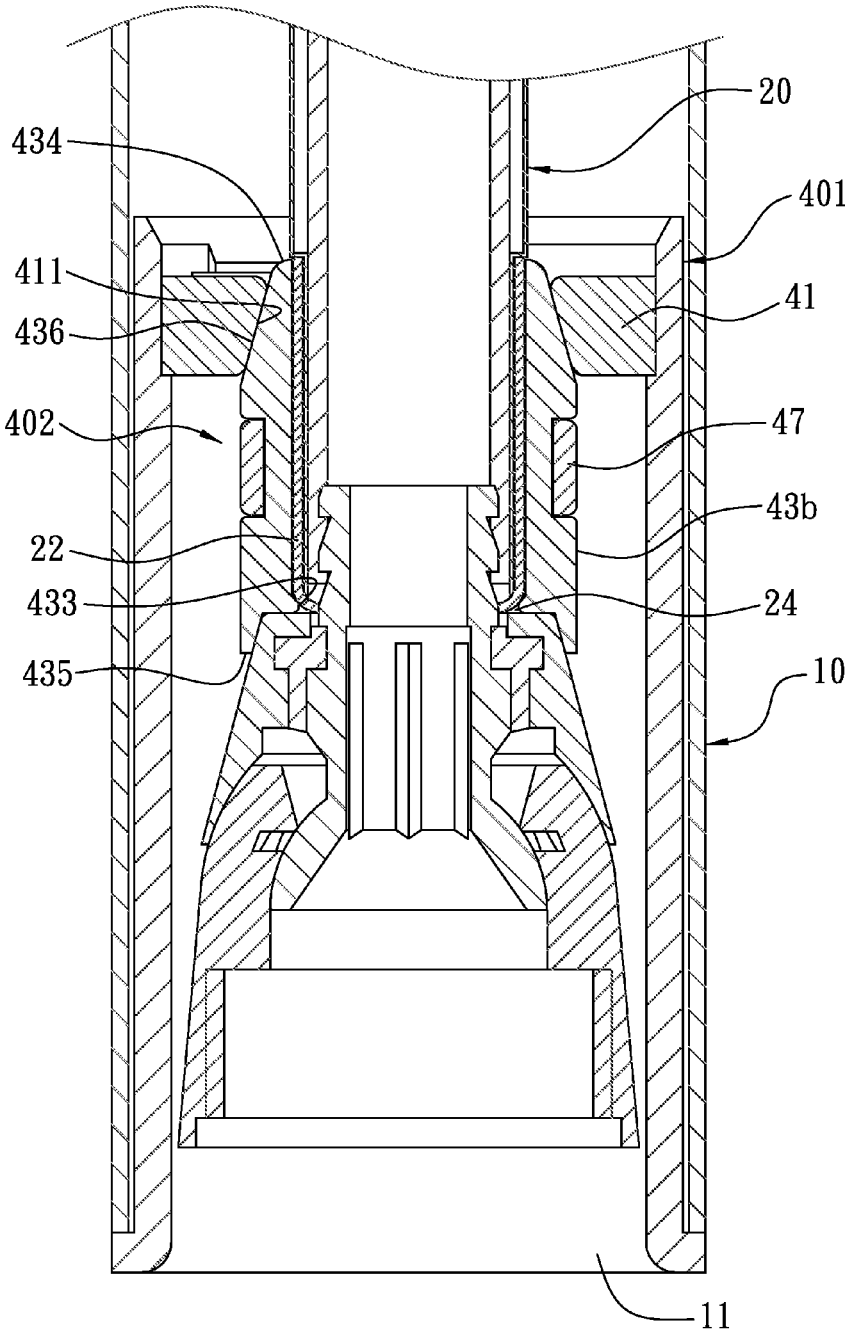
FIG. 20 is a cross sectional view showing the assembly of a part of the positioning structure of the water supply hose for the pull-out faucet according to the second embodiment of the present invention.

With reference to FIG. 18, a difference of a positioning structure of a water supply hose of a third embodiment from that of the first embodiment comprises:

a second connecting member 402 having an engaging element 47 made of plastic material so as to engage a second attracting element **43*b* on an outer wall of a limiting sleeve 22; wherein a profile of the engaging element 47 is similar to the second attracting element 43 of the first embodiment, a profile of the second attracting element 43***b* is similar to the guiding sheath 44 of the first embodiment, but the guiding sheath 44 is a single component, the second attracting element 43*b* of the third embodiment is two-part component and has two symmetrically hollow casings 430 covering each other so as to form an affixing cover for covering the outer wall of the limiting sleeve 22.

Preferably, the engaging element 47 is made of polyformaldehyde (POM).

The second attracting element 43*b* is formed in a sleeve shape and has a trough 432 formed around an outer wall thereof so as to retain with the engaging element 47, and the second attracting element is a magnetically attractive material, the first attracting element is a magnet.

The second attracting element 43*b* also has a tab 433 extending outwardly around an inner wall thereof so as to retain with an annular groove 24 of a water supply hose 20, thus limiting the second attracting element 43*b* to move along the limiting sleeve 22.

The first attracting element 41 of the first embodiment is circular and has the orifice 411 so that the second attracting element 43*b* magnetically attracts with the first attracting element 41 after moving into the orifice 411.

It is to be noted that the second attracting element 43*b* has an internal edge 434, an external edge 435, and a conical leading surface 436 formed on the outer wall thereof proximate to the internal edge 434, such that the second attracting element 43*b* is guided by the conical leading surface 436 to move into the orifice 411 so as to magnetically attract with the first attracting element 41.

The engaging element 47 is fitted above the limiting sleeve 22 of the water supply hose 20 and then is moved downwardly so as to slide into and retain with the trough 432 via the conical leading surface 436.

Figure 21:
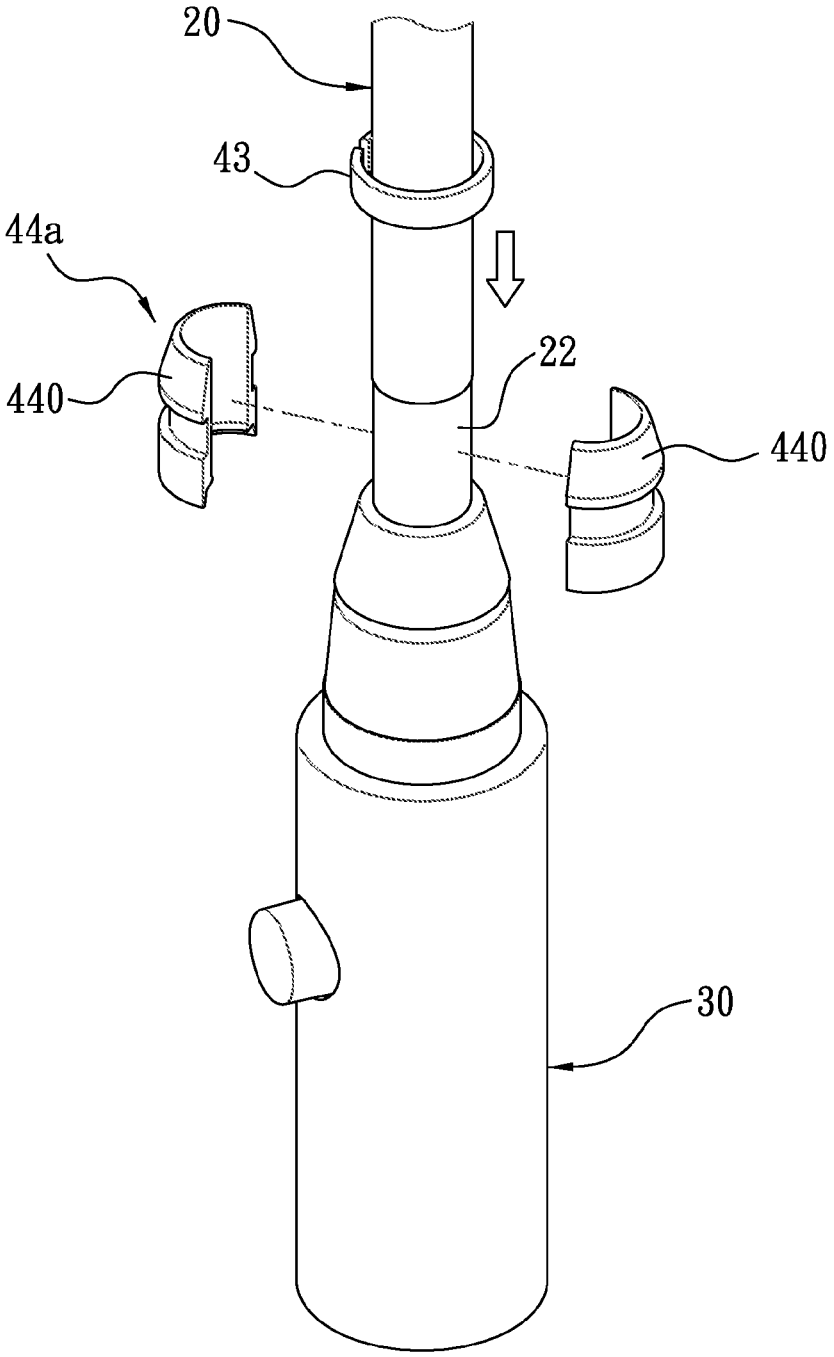
FIG. 21 is a perspective view showing the operation of a second connecting member of a positioning structure of a water supply hose for a pull-out faucet according to a fourth embodiment of the present invention.

Referring to FIG. 21, a difference of a positioning structure of a water supply hose of a fourth embodiment from that of the first embodiment comprises:

a guiding sheath 44 of the first embodiment is replaced by a guiding sheath 44*a* of the fourth embodiment, wherein the guiding sheath 44 of the first embodiment is a single component, and the guiding sheath 44*a* of the fourth embodiment is a two-part component, for example, the guiding sheath 44*a* has two symmetrically hollow casings 440 for covering an outer wall of a limiting sleeve 22.

It is to be noted that the guiding sheath 44 of the first embodiment is rotatably opened or closed, and the guiding sheath 44*a* of the fourth embodiment is connected or removed by covering or removing the two symmetrically hollow casings 440.

Figure 22:
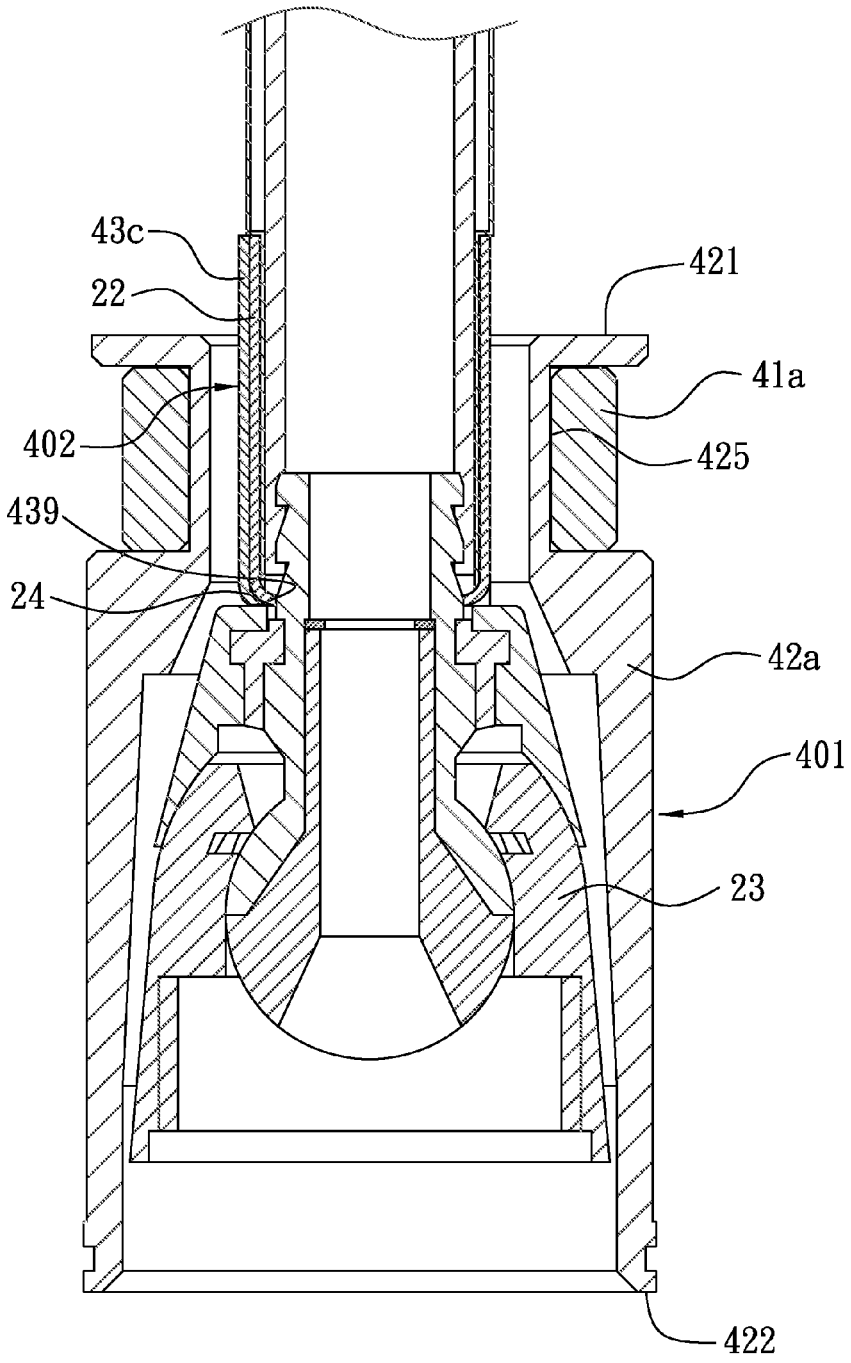
FIG. 22 is a cross sectional view showing the assembly of a part of a positioning structure of a water supply hose for a pull-out faucet according to a fifth embodiment of the present invention.

As shown in FIG. 22, a difference of a positioning structure of a water supply hose of a fifth embodiment from that of the first embodiment comprises:

a fixing loop 42*a* having a circular notch 425 defined on an outer wall thereof opposite to an inner peripheral segment 421 so as to retain a first attracting element 41*a*.

Figure 23:
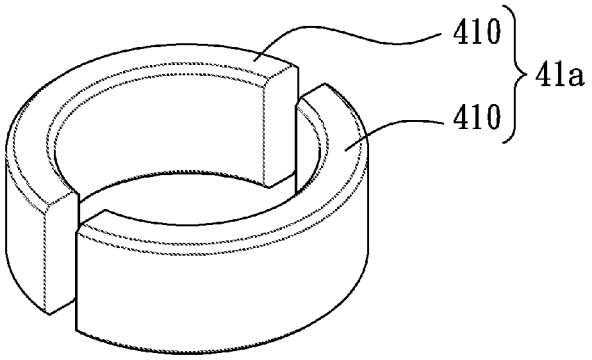
FIG. 23 is a perspective view showing the exploded components of a first attracting element of a positioning structure of a water supply hose for a pull-out faucet according to a fifth embodiment of the present invention.

As illustrated in FIG. 23, the first attracting element 41*a* of the fifth embodiment is circular and is not a single component, for instance, the first attracting element 41*a* has two semi-circular magnets 410 for magnetically attracting each other so that the first attracting element 41*a* is retained in the circular notch 425.

Figure 24:
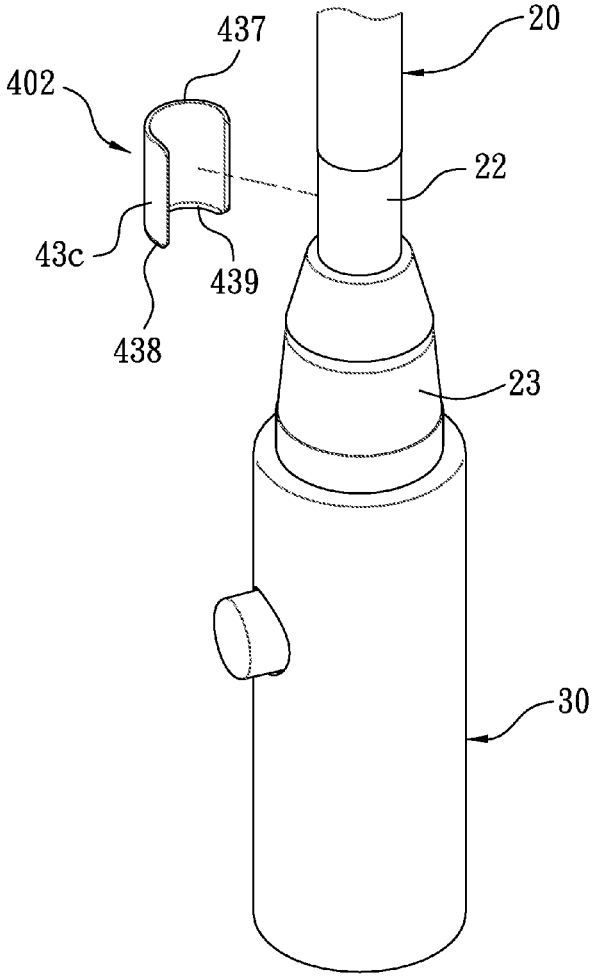
FIG. 24 is a perspective view showing the operation of a second connecting member of the positioning structure of the water supply hose for the pull-out faucet according to the fifth embodiment of the present invention.

As illustrated in FIG. 24, a second connecting member 402 is comprised of a second attracting element 43*c*. The second attracting element 43*c* is in a C-shaped tube shape and is a magnetically attractive material. The second attracting element 43*c* is retained on an outer wall of a limiting sleeve 22 and has an inner rim 437, an outer rim 438, and a lump 439 arranged on an inner wall thereof opposite to the outer rim 438 so as to retain with an annular groove 24 of a water supply hose 20, thus limiting the second attracting element 43*c* to move along the limiting sleeve 22. The second attracting element 43*a* moves into a fixing loop 42*a* with the water supply hose 20 so as to magnetically attract with the first attracting element 41*a*.

Preferably, the second attracting element 43*c* is heat treated from a high carbon steel.

Figure 25:
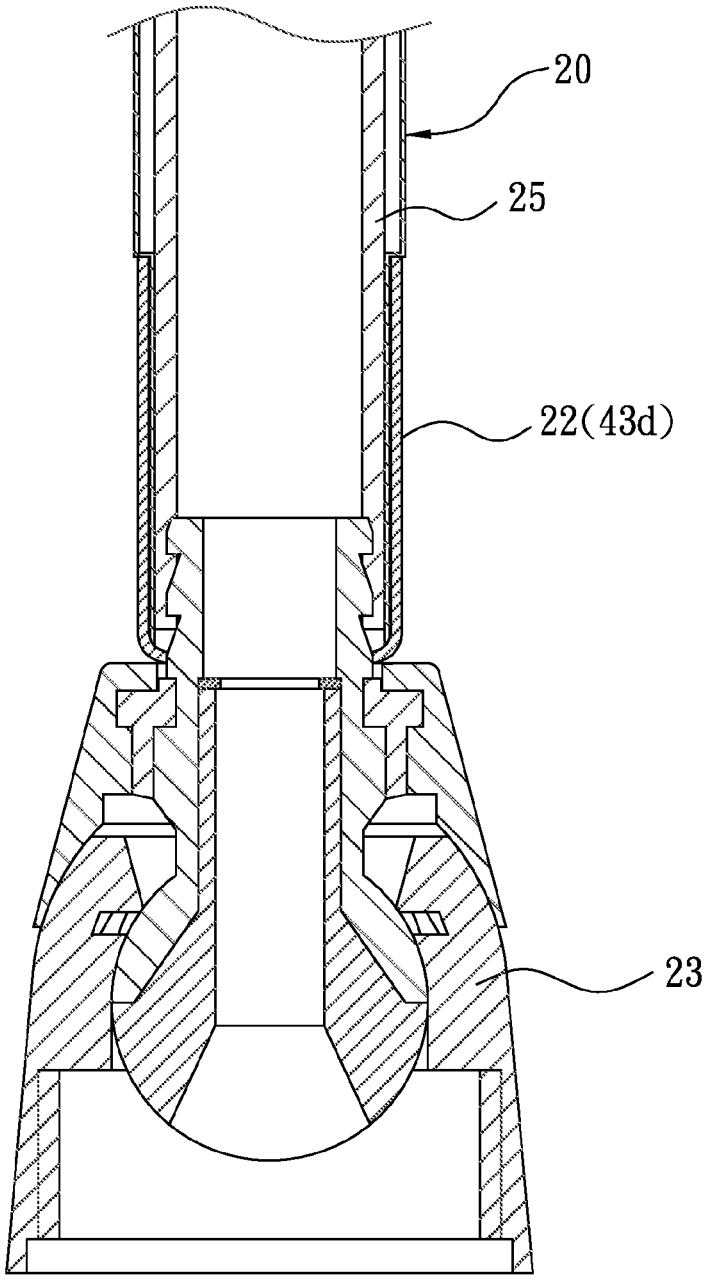
FIG. 25 is a cross sectional view showing the assembly of an outlet segment of the positioning structure of the water supply hose for the pull-out faucet according to a sixth embodiment of the present invention.
Figure 26:
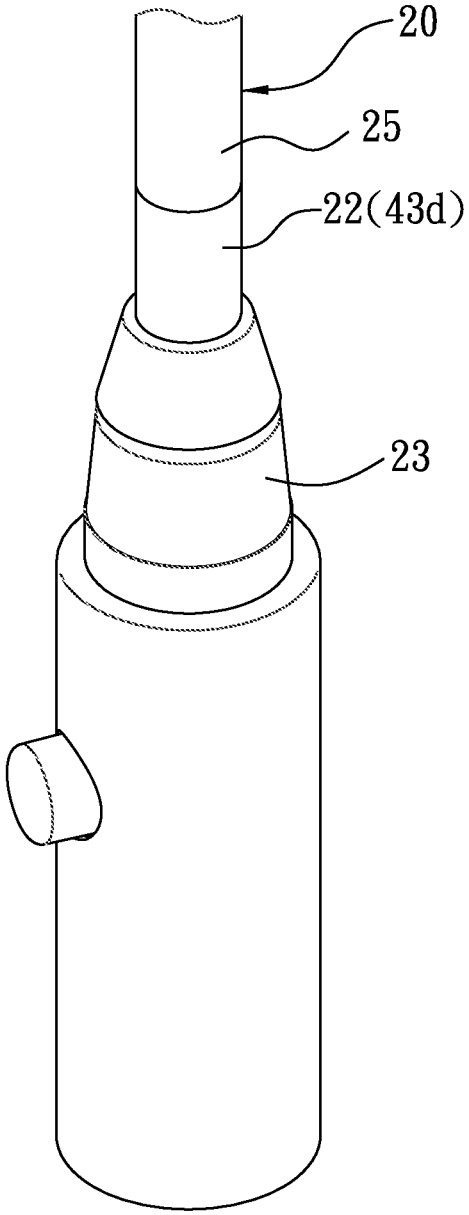
FIG. 26 is a perspective view showing the operation of a second connecting member of the positioning structure of the water supply hose for the pull-out faucet according to the sixth embodiment of the present invention.
Figure 27:
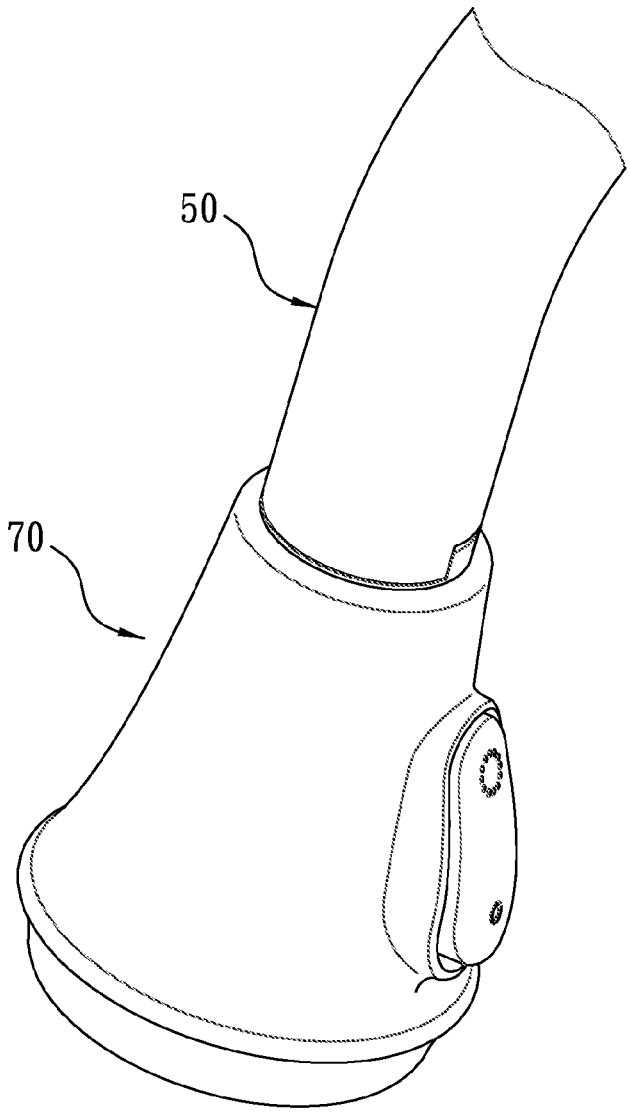
FIG. 27 is a perspective view showing the assembly of a positioning structure of a water supply hose for a pull-out faucet according to a seventh embodiment of the present invention.
Figure 28:
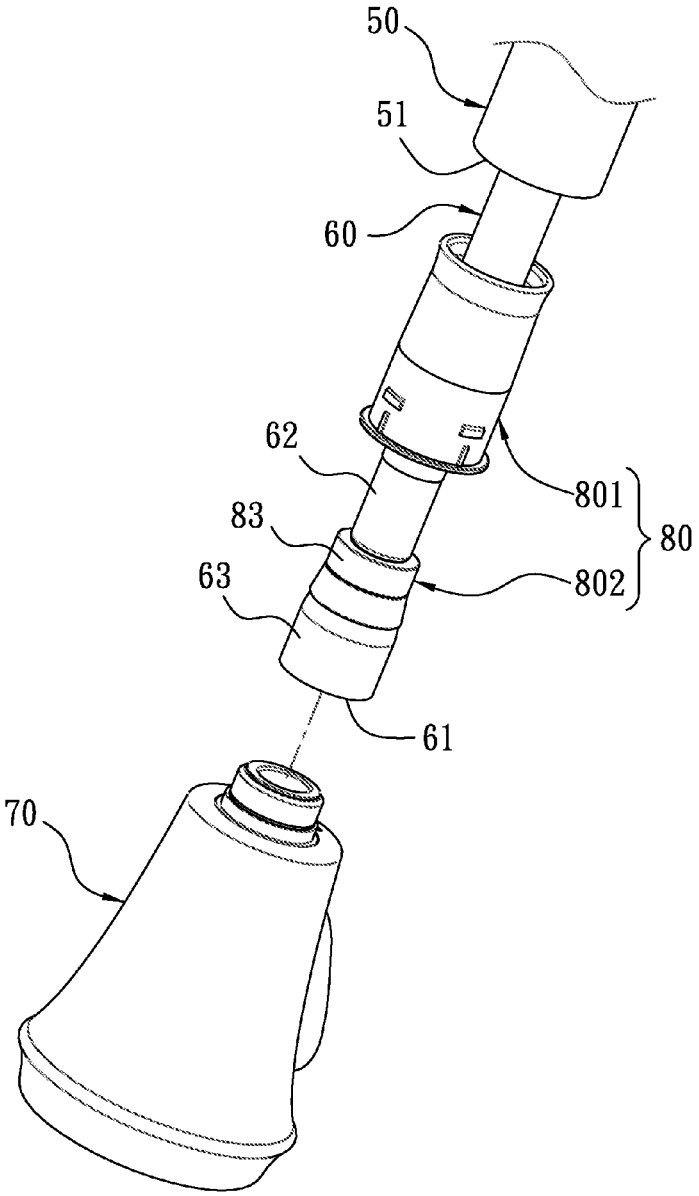
FIG. 28 is a perspective view showing the exploded components of the positioning structure of the water supply hose for the pull-out faucet according to the seventh embodiment of the present invention.

As shown in FIG. 25, a difference of a positioning structure of a water supply hose of a sixth embodiment from that of the fifth embodiment comprises:

a second attracting element 43*d* made of a magnetically attractive material so as to replace the limiting sleeve 22 of the fifth embodiment which is made of stainless steel. In other words, the second attracting element 43*d* of the sixth embodiment is used as the limiting sleeve 22 of the fifth embodiment and to retain a connector 23 on an outflow end of a flexibly tubular member 25, thereby forming a water supply hose 20.

As illustrated in FIGS. 27 to 31, a difference of a positioning structure of a water supply hose of a seventh embodiment comprises: a faucet body 50, a water supply hose 60, a spraying head 70, and a magnetic attraction device 80.

The faucet body 50 includes an outlet 51.

The water supply hose 60 is accommodated in the faucet body 50 so as to supply water and includes an outlet segment 61; wherein the outlet segment 61 has a limiting sleeve 62 and a connector 63.

The spraying head 70 is connected with the outlet segment 61 of the water supply hose 60 and is pulled outwardly and retracted inwardly with the water supply hose 60 by a user.

The magnetic attraction device 80 includes a first connecting member 801 and a second connecting member 802 which magnetically attract with each other; the first connecting member 801 is disposed in the outlet 51 of the faucet body 50; the second connecting member 802 is mounted on an outlet segment 61 of the water supply hose 60; the second connecting member 802 retracts back to its original position with the water supply hose 60 and the spraying head 70 and moves into the outlet 51 of the faucet body 50 so as to magnetically attract with the first connecting member 401, hence the water supply hose 60 and the spraying head 70 are magnetically attracted and fixed.

Preferably, the first connecting member 801 has a first attracting element 81, and the first attracting element 81 is one of a magnet and a magnetically attractive material; the second connecting member 802 is comprised of a second attracting element 83, and the second attracting element 83 is the other of the magnet and the magnetically attractive material.

The first connecting member 801 has the first attracting element 81 and a fixing loop 82; the fixing loop 82 is fitted in the outlet 51 of the faucet body 50 so as to connect with the first attracting element 81.

Figure 30:
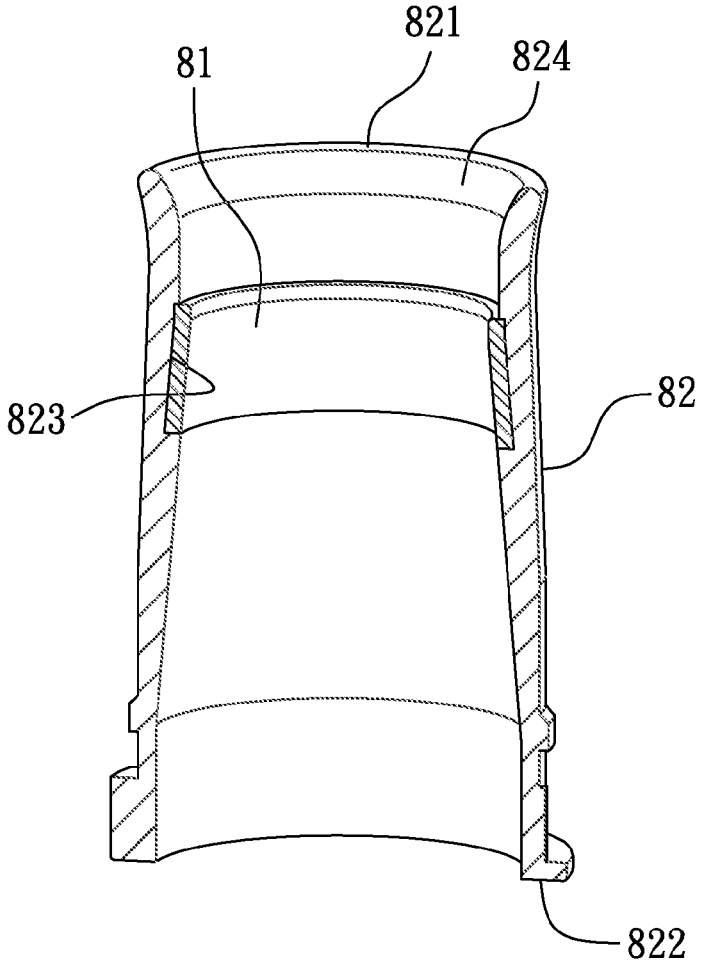
FIG. 30 is a cross-sectional perspective view showing the assembly of a first connecting member of the positioning structure of the water supply hose for the pull-out faucet according to the seventh embodiment of the present invention.

The fixing loop 82 has an inner peripheral segment 821, an outer rib 822 as shown in FIG. 30, and an annular cutout 823 defined around an inner wall thereof adjacent to the inner peripheral segment 821, such that the first attracting element 81 is slid and retained in the annular cutout 823 from the fixing loop 82. The first attracting element 81 is the magnetically attractive material.

To fix the first attracting element 81 easily, the fixing loop 82 also has a conical cliff 824 formed on an opening thereof opposite to the inner peripheral segment 821 so that the first attracting element 81 is guided by the conical cliff 824 to retain in the annular cutout 823.

The second connecting member 802 is comprised of the second attracting element 83 defined between the limiting sleeve 62 and the connector 63.

Figure 31:
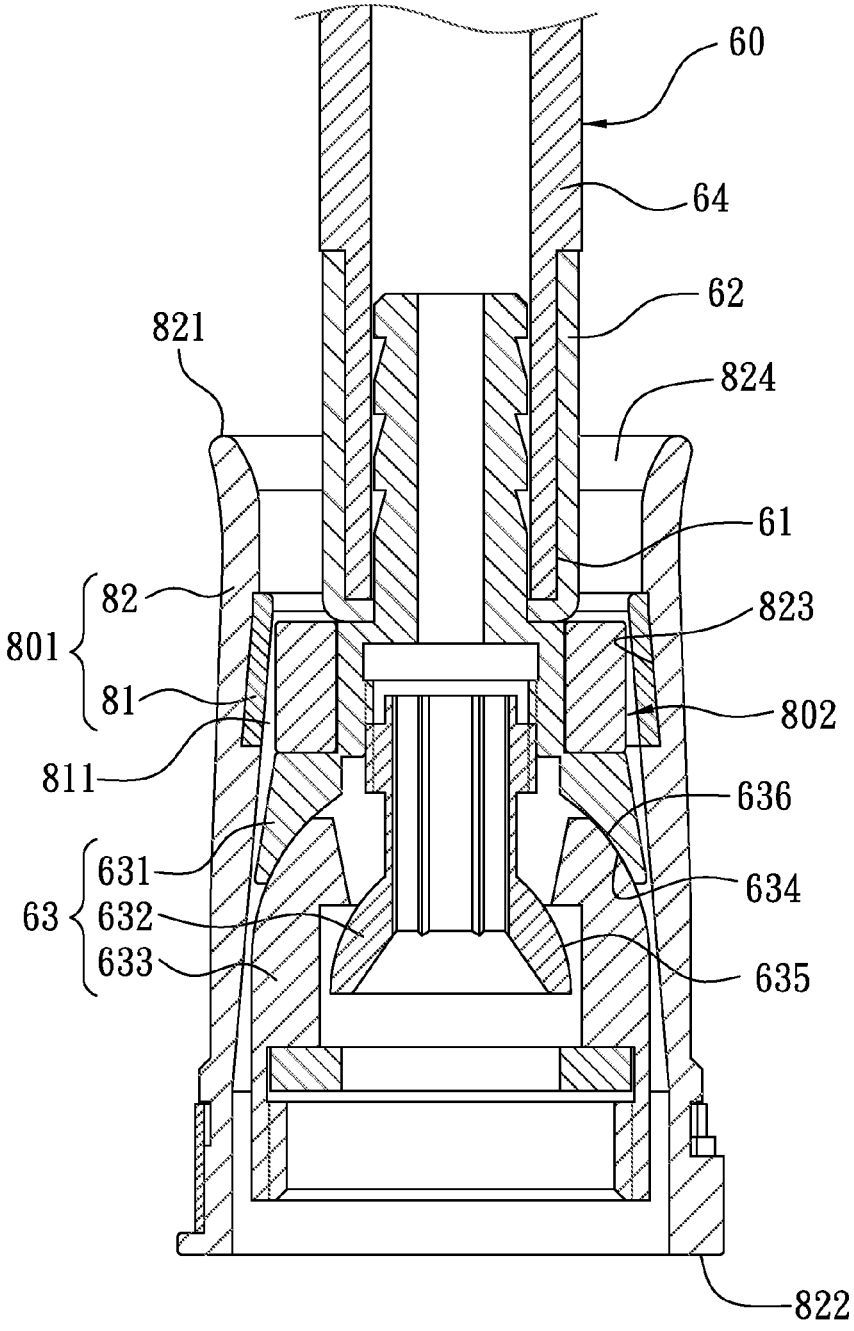
FIG. 31 is a cross sectional view showing the assembly of an outlet segment of the positioning structure of the water supply hose for the pull-out faucet according to the seventh embodiment of the present invention.

It is to be noted that the water supply hose 60 further includes a flexibly tubular member 64 as shown in FIG. 31; the connector 63 is inserted into an outflow end of the flexibly tubular member 64, and the limiting sleeve 62 is retained on the outflow end of the flexibly tubular member 64. Since the water supply hose 60 is a well-known art, further remarks are omitted.

The second attracting element 83 is fitted onto the outflow end of the flexibly tubular member 64 before the limiting sleeve 62 retains the connector 63, such that the second attracting element 83 is defined between the limiting sleeve 62 and the connector 63 after the limiting sleeve 62 retains the connector 63, thus positioning the second attracting element 83.

The connector 63 includes a bushing 631, an internal joint 632, and an external joint 633; the bushing 631 is fitted on an outer wall of the outflow end of the flexibly tubular member 64 so as to limit the second attracting element 83 to move toward the outflow end of the flexibly tubular member 64, wherein the bushing 631 has a spherically inner fence 634 defined thereon; the internal joint 632 is inserted into the outflow end of the flexibly tubular member 64 and is retained on the flexibly tubular member 64 by the limiting sleeve 62, wherein the internal joint 632 has a spherically outer fence 635 formed thereon; the external joint 633 is defined between the spherically inner fence 634 of the bushing 631 and the spherically outer fence 635 of the internal joint 632 so as to screw with the spraying head 70, and wherein the external joint 633 have a spherical face 636 arranged on an outer wall thereof so as to rotatably contact with the spherically inner fence 634 of the bushing 631.

The first attracting element 81 is the magnetically attractive material and is circular, and the first attracting element 81 has a orifice 811 defined thereon; the second attracting element 83 is the magnet and magnetically attracts with the first attracting element 81 when it moves into the orifice 811 and faces to the first attracting element 81.

It is to be noted that two water supply hoses 20, 60 are retracted back to their original positions with two spraying heads 30, 70 by means of two weight blocks on the two water supply hoses 20, 60. In addition, the user can manually retract the two water supply hoses 20, 60 back to their original positions by using two balancing weights on the two water supply hoses 20, 60. Due to such two retracting manners are a well-known art, further remarks are omitted.

When two second connecting members 402, 802 of the two water supply hoses 20, 60 move close to two first connecting members 401, 801 in two outlets 11, 51 of two faucet bodies 10, 50 in two retracting processes of the two water supply hoses 20, 60, they magnetically attract with the two first connecting members 401, 801 quickly.

Figure 29:
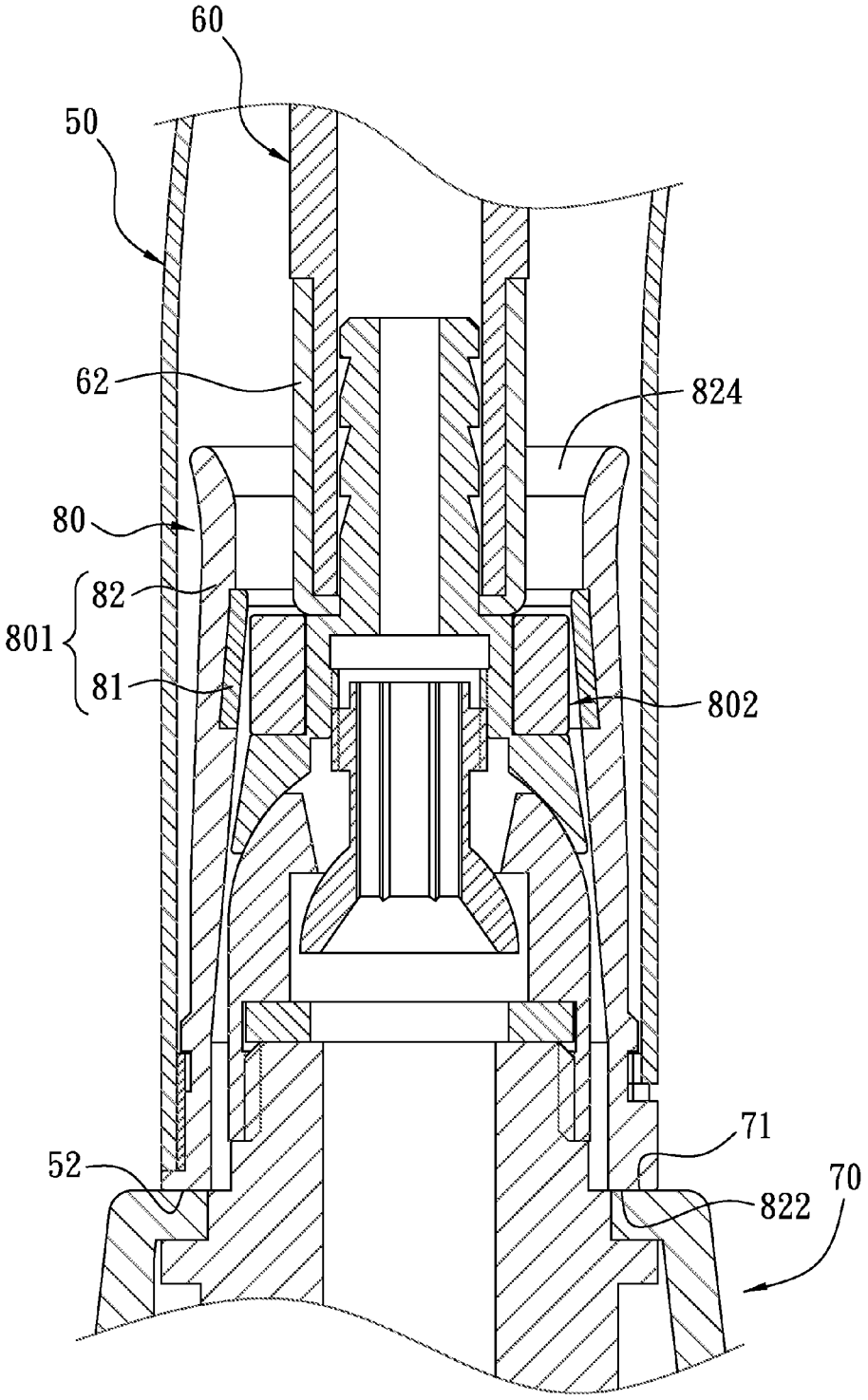
FIG. 29 is a cross sectional view showing the assembly of a part of the positioning structure of the water supply hose for the pull-out faucet according to the seventh embodiment of the present invention.

Preferably, two magnetic attraction devices 40, 80 can match with a mechanical positioning structure, for example, as shown in FIGS. 2 and 29, the two outlets 11, 51 of the two faucet bodies 10, 50 include two confining margins 12, 52 formed thereon, and the two spraying heads 30, 70 include two abutting peripheries 31, 71 defined thereon and corresponding to the two confining margins 12, 52, such that when the two spraying heads 30, 70 are retracted back to their original positions, the two abutting peripheries 31, 71 are biased against the two confining margins 12, 52. In the seventh embodiment, the two confining margins 12, 52 may be formed by two fixing loops 42, 82 of the two first connecting members 401, 801 or by two fixation seats welded on two inner walls of the two outlets 11, 51 of the two faucet bodies 10, 50.

As described above, each of four first attracting elements 41, 410, 41*a*, 81 of above-mentioned embodiments is one of the magnet and the magnetically attractive material, and each of six second attracting elements 43, 43*a*, 43*b*, 43*c*, 43*d*, 83 of the above-mentioned embodiments is the other of the magnet and the magnetically attractive material. Also, each of the four first attracting elements 41, 410, 41*a*, 81 and each of the six second attracting elements 43, 43*a*, 43*b*, 43*c*, 43*d*, 83 can be a magnet.

Thereby, the positioning structure of the water supply hose of the present invention has advantages as follows:

1. Because between the two outlets 11, 51 of the two faucet bodies 10, 50 and two outlet segments 21, 61 of the two water supply hoses 20, 60 are defined the two magnetic attraction devices 40, 80, when the two water supply hoses 20, 60 are retracted back to their original positions with the two spraying heads 30, 70, the two water supply hoses 20, 60 and the two spraying heads 30, 70 are attracted and fixed by the two magnetic attraction devices 40, 80.

2. The two magnetic attraction devices 40, 80 are mounted on the two water supply hoses 20, 60 instead of a conventional spraying head, so the user can remove and replace the two spraying heads 30, 70 easily, and the two magnetic attraction devices 40, 80 cannot be interfered while replacing the two spraying heads 30, 70.

3. The two first connecting members 401, 801 of the two magnetic attraction devices 40, 80 magnetically attract with the two connecting members 402, 802 in a radial direction instead of a conventionally axial direction, so a gap between a respective one of two first connecting members 401, 801 and a respective one of the two second connecting members 402, 802 is maintained at a larger connecting tolerance while the respective one of the two first connecting members 401, 801 magnetically attracts with the respective one of the two connecting members 402, 802, thus obtaining easy manufacture and assembly. In addition, the respective one of the two first connecting members 401, 801 will not contact with the respective one of the two second connecting members 402, 802 and will not interfere positioning operation of the two spraying heads 30, 70.

4. The two first connecting members 401, 801 of the two magnetic attraction devices 40, 80 are served to replace a conventional fixing loop in the faucet body and to magnetically attract with the two second connecting members 402, 802 without removing the two water supply hoses 20, 60 and the two spraying heads 30, 70, thereby positioning the two second connecting members 402, 802 easily.

5. The two magnetic attraction devices 40, 80 are replaced or connected conveniently.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A positioning structure of a water supply hose for a pull-out faucet comprising:

a faucet body including an outlet;

a water supply hose accommodated in the faucet body so as to supply water and including an outlet segment;

a spraying head connected with the outlet segment of the water supply hose and being pulled outwardly and retracted inwardly with the water supply hose by a user;

a magnetic attraction device including a first connecting member and a second connecting member which magnetically attract with each other; the first connecting member being disposed in the outlet of the faucet body; the second connecting member being mounted on an outlet segment of the water supply hose; the second connecting member retracting back to its original position with the water supply hose and the spraying head and moving into the outlet of the faucet body so as to magnetically attract with the first connecting member, hence the water supply hose and the spraying head are magnetically attracted and fixed;

wherein the first connecting member has a first attracting element, and the second connecting member has a second attracting element for magnetically attracting with the first attracting element;

wherein the first connecting member further includes a fixing loop fitted in the outlet of the faucet body so as to connect with the first attracting element;

wherein the fixing loop has an inner peripheral segment, an outer rib, an inner shoulder surrounding around an inner wall thereof opposite to the inner peripheral segment, and at least one locking block; the first attracting element is circular and is retained between the inner shoulder and the at least one locking block through the at least one locking block, and the first attracting element is a magnet, the second attracting element is a magnetically attractive material.

2. The positioning structure of the water supply hose for the pull-out faucet as claimed in claim 1, characterized in that the first connecting member has a first attracting element, and the first attracting element is one of a magnet and a magnetically attractive material; the second connecting member has a second attracting element, and the second attracting element is the other of the magnet and the magnetically attractive material.

3. The positioning structure of the water supply hose for the pull-out faucet as claimed in claim 1, characterized in that each of the first connecting member and the second connecting member is a magnet.

4. The positioning structure of the water supply hose for the pull-out faucet as claimed in claim 1, characterized in that the outlet segment of the water supply hose has a limiting sleeve; the second connecting member further has a guiding sheath applied to accommodate the second attracting element and fixed on the limiting sleeve of the water supply hose.

5. The positioning structure of the water supply hose for the pull-out faucet as claimed in claim 4, characterized in that the guiding sheath is one piece made of plastic material and is hollow, and the guiding sheath has an elongated aperture longitudinally defined on an outer wall thereof so that the guiding sheath covers an outer wall of the limiting sleeve of the water supply hose by ways of the elongated aperture;

wherein the guiding sheath also has a longitudinal slot formed on the outer wall thereof opposite to the elongated aperture, and the longitudinal slot has a thinner wall than the outer wall of the guiding sheath so as to rotatably open and close the elongated aperture.

6. The positioning structure of the water supply hose for the pull-out faucet as claimed in claim 4, characterized in that the guiding sheath further has a positioning trench defined around the outer wall thereof; the second attracting element is formed in a C shape, such that the second attracting element is flexibly retained in the positioning trench of the guiding sheath, and the second attracting element is a magnetically attractive material, the first attracting element is a magnet.

7. The positioning structure of the water supply hose for the pull-out faucet as claimed in claim 4, characterized in that the outlet segment of the water supply hose further has a connector and an annular groove defined between the limiting sleeve and the connector; the guiding sheath further has a protrusion formed around an inner wall thereof so as to retain with the annular groove of the water supply hose, such that the guiding sheath is limited to move along the limiting sleeve.

8. The positioning structure of the water supply hose for the pull-out faucet as claimed in claim 4, characterized in that the first attracting element is a magnet and is circular, the first attracting element has an orifice defined thereon; the second attracting element is a magnetically attractive material and is moved into the first attracting element to magnetically attract with the first attracting element.

9. The positioning structure of the water supply hose for the pull-out faucet as claimed in claim 8, characterized in that the guiding sheath further has an internal segment, an external segment, and a conical guide face formed on an outer wall thereof adjacent to the internal segment so as to guide the guiding sheath to fit into the orifice of the first attracting element, such that the second attracting element on the guiding sheath faces to and magnetically attracts with the first attracting element;

wherein the guiding sheath further has a positioning trench defined around the outer wall thereof; the second attracting element is formed in a C shape, such that before connecting the guiding sheath, the second attracting element is fitted on the limiting sleeve of the water supply hose and then is moved downwardly so that the second attracting element is guided to move into the positioning trench by using the conical guide face of the guiding sheath, thus retaining the second attracting element in the positioning trench.

* * * * *